US011685497B2

(12) United States Patent
Fujino

(10) Patent No.: US 11,685,497 B2
(45) **Date of Patent: *Jun. 27, 2023**

(54) MARINE VESSEL MANEUVERING SYSTEM, AND MARINE VESSEL

(71) Applicant: YAMAHA HATSUDOKI KABUSHIKI KAISHA, Iwata (JP)

(72) Inventor: Kenichi Fujino, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/564,382

(22) Filed: Dec. 29, 2021

(65) Prior Publication Data

US 2022/0119088 A1 Apr. 21, 2022

Related U.S. Application Data

(63) Continuation of application No. 16/993,315, filed on Aug. 14, 2020, now Pat. No. 11,235,849.

(30) Foreign Application Priority Data

Aug. 22, 2019 (JP) ..... 2019-152101

(51) Int. Cl.
*B63H 25/02* (2006.01)
*B63B 79/40* (2020.01)

(52) U.S. Cl.
CPC ..... *B63H 25/02* (2013.01); *B63B 79/40* (2020.01); *B63H 2025/022* (2013.01)

(58) Field of Classification Search
CPC .. B63H 25/00; B63H 25/02; B63H 2025/022; B63B 79/40
USPC ..... 440/1
See application file for complete search history.

(56) References Cited

U.S. PATENT DOCUMENTS 11,235,849 B2 * 2/2022 Fujino ..... B63H 25/02

OTHER PUBLICATIONS

Fujino, "Marine Vessel Maneuvering System, and Marine Vessel", U.S. Appl. No. 16/993,315, filed Aug. 14, 2020.

* cited by examiner

*Primary Examiner* — Lars A Olson
(74) *Attorney, Agent, or Firm* — Keating and Bennett, LLP

(57) ABSTRACT

A marine vessel maneuvering system includes a propulsion device, a steering device, a forward/reverse drive switch, a steering wheel, a forward drive operator, a reverse drive operator, and a controller. The forward drive operator and the reverse drive operator are respectively located on one and the other sides of a pivot axis of the steering wheel, and are pivotable together with the steering wheel. The controller performs a forward drive propulsion control and a reverse drive propulsion control to set the propulsive force direction and control a magnitude of the propulsive force according to the operation of the forward drive operator and the reverse drive operator. The controller enables the forward drive propulsion control in a forward drive operation valid range. The controller enables the reverse drive propulsion control in a reverse drive operation valid range.

8 Claims, 14 Drawing Sheets

+60 DEGREE POSITION
30L
20
30R
+150 DEGREES

+30 DEGREES
+120 DEGREE POSITION
30L
20
30R
(ORDINARY) FORWARD DRIVE OPERATION VALID RANGE

0 DEGREE POSITION
-90 DEGREE POSITION
+90 DEGREE POSITION
30L
30R
20
-60 DEGREE POSITION

-30 DEGREES
30R
20
30L
-120 DEGREE POSITION
(ORDINARY) REVERSE DRIVE OPERATION VALID RANGE 30R
30L
20
-150 DEGREES

MARINE VESSEL MANEUVERING SYSTEM, AND MARINE VESSEL

CROSS REFERENCE TO RELATED APPLICATIONS

This application claims the benefit of priority to Japanese Patent Application No. 2019-152101 filed on Aug. 22, 2019. The entire contents of this application are hereby incorporated herein by reference.

BACKGROUND OF THE INVENTION

1. Field of the Invention

The present invention relates to a marine vessel maneuvering system, and a marine vessel including the marine vessel maneuvering system.

2. Description of the Related Art

US 2018/0111671A1 discloses a jet propulsion marine vessel including a steering wheel and a paddle operator. The direction of a propulsive force of a jet propeller is changed laterally according to the pivot operation of the steering wheel, whereby the jet propulsion marine vessel is steered. The paddle operator is pivotable together with the steering wheel. The paddle operator includes a pair of paddles which are respectively located on right and left sides when the steering wheel assumes a neutral position. For example, the right paddle is operated for forward drive shift and forward drive propulsive force control, and the left paddle is operated for reverse drive shift and reverse drive propulsive force control. A marine vessel maneuvering operation using the steering wheel and the paddle operator is particularly useful when the marine vessel needs to be repeatedly shifted between forward drive and reverse drive for docking and undocking.

SUMMARY OF THE INVENTION

The inventor of preferred embodiments of the present invention described and claimed in the present application conducted an extensive study and research regarding a marine vessel maneuvering system, such as the one described above, and in doing so, discovered and first recognized new unique challenges and previously unrecognized possibilities for improvements as described in greater detail below.

In the arrangement disclosed in US 2018/0111671A1, the steering wheel is pivotable clockwise and counterclockwise by an angle θ of less than 90 degrees, i.e., in a total operation angle range 2θ. In other words, when the steering wheel is pivoted by the angle θ from the neutral position, the direction of the propulsive force of the jet propeller reaches the maximum steering angle. With the operation angle range of the steering wheel thus limited, the user of the marine vessel can properly operate the right and left paddles while operating the steering wheel at any desired angle. Since the direction of the propulsive force reaches the maximum steering angle with the steering wheel pivoted by the angle θ, less effort is required for the operation of the steering wheel when docking and undocking.

The paddle operator is preferably available not only when docking and undocking but also during the ordinary sailing of the marine vessel. This facilitates the marine vessel maneuvering operation during the ordinary sailing. During the ordinary sailing, however, the marine vessel speed is higher than when docking and undocking, so that the steering response to the pivot operation of the steering wheel is preferably slower. Therefore, it is preferred to permit the operation of the steering wheel, for example, in an operation angle range of about 300 degrees (including clockwise and counterclockwise angle ranges of about 150 degrees) that is greater than the operation angle range including clockwise and counterclockwise angle ranges θ of less than 90 degrees as disclosed in US 2018/0111671A1. Thus, the marine vessel would be maneuvered with an excellent maneuverability both in the low speed sailing when docking and undocking and during the ordinary sailing.

Where the steering wheel operation is permitted in the greater operation angle range (particularly, the operation angle range including clockwise and counterclockwise angle ranges of not less than 90 degrees), however, there is a possibility that the operation of the paddle operator is difficult in some portions of the operation angle range. For example, the marine vessel user may regrasp the steering wheel. In this case, the right and left hands of the user are brought out of the corresponding relationship with the right and left paddles. If the marine vessel user does not regrasp the steering wheel, this problem can be avoided. However, the user may operate the steering wheel in the greater operation angle range by crossing his right and left arms. This makes it difficult to operate the paddles while operating the steering wheel.

A conceivable approach to this problem is that a valid operation angle range in which the operation of the paddle operator is enabled is limited, for example, to an operation angle range including clockwise and counterclockwise operation angle ranges of less than 90 degrees, while the operation of the steering wheel is permitted in the greater operation angle range. This makes it possible to improve the marine vessel maneuverability, while eliminating or mitigating the aforementioned problem.

However, this approach is likely to deteriorate the marine vessel maneuverability and the user's maneuvering feeling, particularly, when docking and undocking. That is, the user will desire to perform the shift and throttle operations with the use of the paddle operator without releasing his hands from the steering wheel, even if he has to assume a somewhat difficult posture when docking and undocking. In the case of the jet propeller, in particular, the hull cannot be steered without the generation of the propulsive force and, therefore, it is important to provide a paddle operator which facilitates the steering wheel operation as well as the shift and throttle operations.

Preferred embodiments of the present invention provide marine vessel maneuvering systems that each improve the marine vessel maneuverability and the maneuvering feeling, and marine vessels including such marine vessel maneuvering systems.

According to a preferred embodiment of the present invention, a maneuvering system for a marine vessel includes a propulsion device to propel a hull; a steering device to pivot the direction of a propulsive force generated by the propulsion device laterally of the hull; a forward/reverse drive switch to switch the direction of the propulsive force generated by the propulsion device between a forward drive direction and a reverse drive direction; a steering wheel pivotable about a pivot axis in a predetermined full operation angle range clockwise and counterclockwise by a user of the marine vessel to manipulate the steering device; a forward drive operator; a reverse drive operator; and a controller configured or programmed to control the propulsion device and the forward/reverse drive switch according to the operation of the forward drive operator and the reverse drive operator. The forward drive operator is located on one of right and left sides of the pivot axis when the operation angle of the steering wheel is a neutral angle, and is pivotable together with the steering wheel about the pivot axis. The reverse drive operator is located on the other of the right and left sides of the pivot axis when the operation angle of the steering wheel is the neutral angle, and is pivotable together with the steering wheel about the pivot axis. The controller performs a forward drive propulsion control when the forward drive operator is operated to switch the direction of the propulsive force generated by the propulsion device to the forward drive direction, and controls the magnitude of the propulsive force generated by the propulsion device according to the operation amount of the forward drive operator. Further, the controller performs a reverse drive propulsion control when the reverse drive operator is operated to switch the direction of the propulsive force generated by the propulsion device to the reverse drive direction, and controls the magnitude of the propulsive force generated by the propulsion device according to the operation amount of the reverse drive operator. Further, the controller enables the forward drive propulsion control when the operation angle of the steering wheel falls within a forward drive operation valid range defined in the full operation angle range, and disables the forward drive propulsion control when the operation angle of the steering wheel falls outside the forward drive operation valid range. Further, the controller enables the reverse drive propulsion control when the operation angle of the steering wheel falls within a reverse drive operation valid range defined in the full operation angle range, and disables the reverse drive propulsion control when the operation angle of the steering wheel falls outside the reverse drive operation valid range. Further, the controller performs a valid range variable control to variably set at least one of the forward drive operation valid range and the reverse drive operation valid range according to the sailing state of the marine vessel.

With the above structural arrangement, the marine vessel user is able to steer the marine vessel by pivoting the steering wheel. In addition, the user is able to switch the direction of the propulsive force between the forward drive direction and the reverse drive direction, and adjust the magnitude of the propulsive force by operating the forward drive operator and the reverse drive operator. The operation of the forward drive operator is accepted when the operation angle of the steering wheel falls within the forward drive operation valid range, and is negated when the operation angle of the steering wheel falls outside the forward drive operation valid range. Similarly, the operation of the reverse drive operator is accepted when the operation angle of the steering wheel falls within the reverse drive operation valid range, and is negated when the operation angle of the steering wheel falls outside the reverse drive operation valid range.

At least one of the forward drive operation valid range and the reverse drive operation valid range is variably set according to the sailing state of the marine vessel. Since the operation valid ranges are thus properly set according to the sailing state, the marine vessel maneuverability and the maneuvering feeling is improved.

An example of the sailing state of the marine vessel is a docking/undocking sailing state assumed when the marine vessel is docked or undocked. Another example of the sailing state is an ordinary sailing state other than the docking/undocking sailing state. The sailing state is able to be determined or detected based on a maneuvering operation unique to docking or undocking, the speed of the marine vessel, a distance from the marine vessel to a docking site (quay, pier, some other marine vessel, or the like), the current position of the marine vessel, the direction of the propulsive force, and the like. In other words, the sailing state of the marine vessel includes the user's maneuvering state, the marine vessel speed, a distance to a nearby object, the current position of the marine vessel, the direction of the propulsive force, and the like.

In a preferred embodiment of the present invention, the valid range variable control includes a valid range expansion control to perform a docking/undocking determination operation to determine whether the sailing state of the marine vessel is the docking/undocking sailing state and, if the marine vessel sailing state is the docking/undocking sailing state, expanding at least the reverse drive operation valid range out of the forward drive operation valid range and the reverse drive operation valid range as compared with an ordinary valid range.

With the above structural arrangement, at least the reverse drive operation valid range is expanded as compared with the ordinary valid range when docking and undocking. Thus, the operation of at least the reverse drive operator is validly accepted in a wider operation angle range when docking and undocking. This facilitates the marine vessel maneuvering operation when docking and undocking, and improves the maneuvering feeling. On the other hand, the ordinary valid range is used in a sailing state other than the docking/undocking sailing state. Thus, the valid operation range for the reverse drive operator is limited to a proper operation angle range.

In a preferred embodiment of the present invention, the reverse drive operator is located on the left side of the pivot axis when the steering angle of the steering wheel is the neutral angle. For example, the ordinary valid range for the reverse drive operator includes a range from the neutral angle to a counterclockwise angle of not greater than about 60 degrees (e.g., about 30 degrees in a preferred embodiment of the present invention), and a range from the neutral angle to a clockwise angle of not greater than about 210 degrees (e.g., about 150 degrees in a preferred embodiment of the present invention). The valid range expansion control expands the reverse drive operation valid range from the ordinary valid range, for example, by a counterclockwise angle of not less than about 90 degrees (e.g., about 120 degrees in a preferred embodiment of the present invention).

In a preferred embodiment of the present invention, the forward drive operator is located on the right side of the pivot axis when the operation angle of the steering wheel is the neutral angle. For example, the ordinary valid range for the forward drive operator includes a range from the neutral angle to a clockwise angle of not greater than about 60 degrees (e.g., 30 degrees in a preferred embodiment of the present invention), and a range from the neutral angle to a counterclockwise angle of not greater than about 210 degrees (e.g., about 150 degrees in a preferred embodiment of the present invention). The valid range expansion control expands the forward drive operation valid range from the ordinary valid range, for example, by a clockwise angle of not less than about 90 degrees (e.g., about 120 degrees in a preferred embodiment of the present invention).

In a preferred embodiment of the present invention, the docking/undocking determination operation includes a repeated reversal determination operation to determine whether the operating direction of the steering wheel is reversed between a clockwise direction and a counterclockwise direction a plurality of times in a predetermined period of time, and the docking/undocking determination operation determines that the sailing state of the marine vessel is the docking/undocking sailing state if the operating direction of the steering wheel is reversed between the clockwise direction and the counterclockwise direction the plurality of times in the predetermined period of time.

When docking and undocking, the marine vessel user repeatedly reverses the operating direction of the steering wheel between the clockwise direction and the counterclockwise direction. Therefore, when the user operates the steering wheel in this way, it is determined that the marine vessel is in the docking/undocking sailing state.

Alternatively, the docking/undocking determination operation may be performed based on a condition that the marine vessel sails at a speed not higher than a predetermined speed in a low speed sailing state, that a docking/undocking operator (e.g., docking/undocking button) is operated when docking and undocking, or that a distance from the marine vessel to the docking site is not greater than a predetermined distance.

In a preferred embodiment of the present invention, the marine vessel maneuvering system includes an operating direction acquirer that acquires the operating direction of the steering wheel. The repeated reversal determination operation determines whether the operating direction of the steering wheel acquired by the operating direction acquirer is reversed between the clockwise direction and the counterclockwise direction a plurality of times in the predetermined period of time.

The operating direction acquirer may include a pivotal position acquirer (specifically, an operation angle sensor) that acquires a pivotal position (specifically, the operation angle of the steering wheel), and may be arranged to acquire the operating direction of the steering wheel based on the pivotal position acquired by the pivotal position acquirer.

In a preferred embodiment of the present invention, the valid range variable control includes a speed-adaptive variable control to variably set at least one of the forward drive operation valid range and the reverse drive operation valid range according to the marine vessel speed.

With the above structural arrangement, the operation of the forward drive operator and/or the operation of the reverse drive operator is enabled in the proper operation angle range according to the marine vessel speed. Thus, the operation valid range is properly variably set according to the sailing state of the marine vessel, thus improving the marine vessel maneuverability and the maneuvering feeling.

In a preferred embodiment of the present invention, the speed-adaptive variable control expands at least one of the forward drive operation valid range and the reverse drive operation valid range when the marine vessel speed is not lower than a predetermined value, and changes neither of the forward drive operation valid range and the reverse drive operation valid range when the marine vessel speed is lower than the predetermined value.

In a preferred embodiment of the present invention, the propulsion device includes a motor and a propulsion unit driven by the motor. The speed-adaptive variable control expands at least one of the forward drive operation valid range and the reverse drive operation valid range when the rotation speed of the motor is not lower than a predetermined value, and changes neither of the forward drive operation valid range and the reverse drive operation valid range when the rotation speed of the motor is lower than the predetermined value.

In the above description, the expressions "not lower than the predetermined value" and "lower than the predetermined value" may be respectively exchanged with expressions "higher than the predetermined value" and "not higher than the predetermined value" with no significant difference in meaning.

In a preferred embodiment of the present invention, the marine vessel maneuvering system further includes an operation angle sensor that detects the operation angle of the steering wheel, and the valid range variable control includes an operation angle calculation characteristic changing control to variably set an operation angle calculation characteristic with respect to an output of the operation angle sensor according to the sailing state of the marine vessel.

For example, the controller performs an enabling/disabling control to enable and disable the operation of the forward drive operator and/or the operation of the reverse drive operator based on a predetermined forward drive operation valid range and/or a predetermined reverse drive operation valid range of the operation angle sensor. On the other hand, the operation angle calculation characteristic is changed according to the sailing state of the marine vessel. Then, the range in which the operation of the forward drive operator and/or the operation of the reverse drive operator is validly accepted is virtually changed by performing the control based on the predetermined forward drive or reverse drive operation valid range. Therefore, substantially the same results are provided as those provided by changing the forward drive operation valid range and/or the reverse drive operation valid range. Thus, the use of the control to change the operation angle calculation characteristic makes it possible to improve the marine vessel maneuverability and the maneuvering feeling while facilitating the control.

For example, a plurality of operation angle calculation characteristics may be prepared in advance, and the controller may be configured or programmed to selectively use the operation angle calculation characteristics according to the sailing state. For example, the operation angle calculation characteristics may include a high speed forward drive characteristic to be used for high speed forward sailing, a low speed forward drive characteristic to be used for low speed forward sailing, a high speed reverse drive characteristic to be used for high speed rearward sailing, and a low speed reverse drive characteristic to be used for low speed rearward sailing.

In a preferred embodiment of the present invention, the reverse drive operation valid range is set to an angle range that is wider than the forward drive operation valid range. The controller enables the reverse drive propulsion control when the operation angle of the steering wheel falls within the reverse drive operation valid range, and disables the reverse drive propulsion control when the operation angle of the steering wheel falls outside the reverse drive operation valid range.

With the above structural arrangement, the marine vessel user is able to steer the marine vessel by pivoting the steering wheel. In addition, the marine vessel user is able to switch the direction of the propulsive force between the forward drive direction and the reverse drive direction and adjust the magnitude of the propulsive force by operating the forward drive operator and the reverse drive operator. The operation of the forward drive operator is accepted when the operation angle of the steering wheel falls within the forward drive operation valid range, and is negated when the operation angle of the steering wheel falls outside the forward drive operation valid range. Similarly, the operation of the reverse drive operator is accepted when the operation angle of the steering wheel falls within the reverse drive operation valid range, and is negated when the operation angle of the steering wheel falls outside the reverse drive operation valid range.

The reverse drive operation valid range is set wider than the forward drive operation valid range. Where the operation of the reverse drive operator is enabled in the wider operation angle range when docking and undocking, for example, it is possible to facilitate the marine vessel maneuvering operation and improve the maneuvering feeling. In the rearward sailing, the marine vessel speed is not so high. Therefore, the limitation of the operation angle range for the reverse drive operator is not so advantageous. Where the reverse drive operation valid range is set wider, therefore, it is possible to improve the marine vessel maneuverability and the maneuvering feeling while facilitating the control.

According to another preferred embodiment of the present invention, a marine vessel includes a hull and the marine vessel maneuvering system including above-described features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
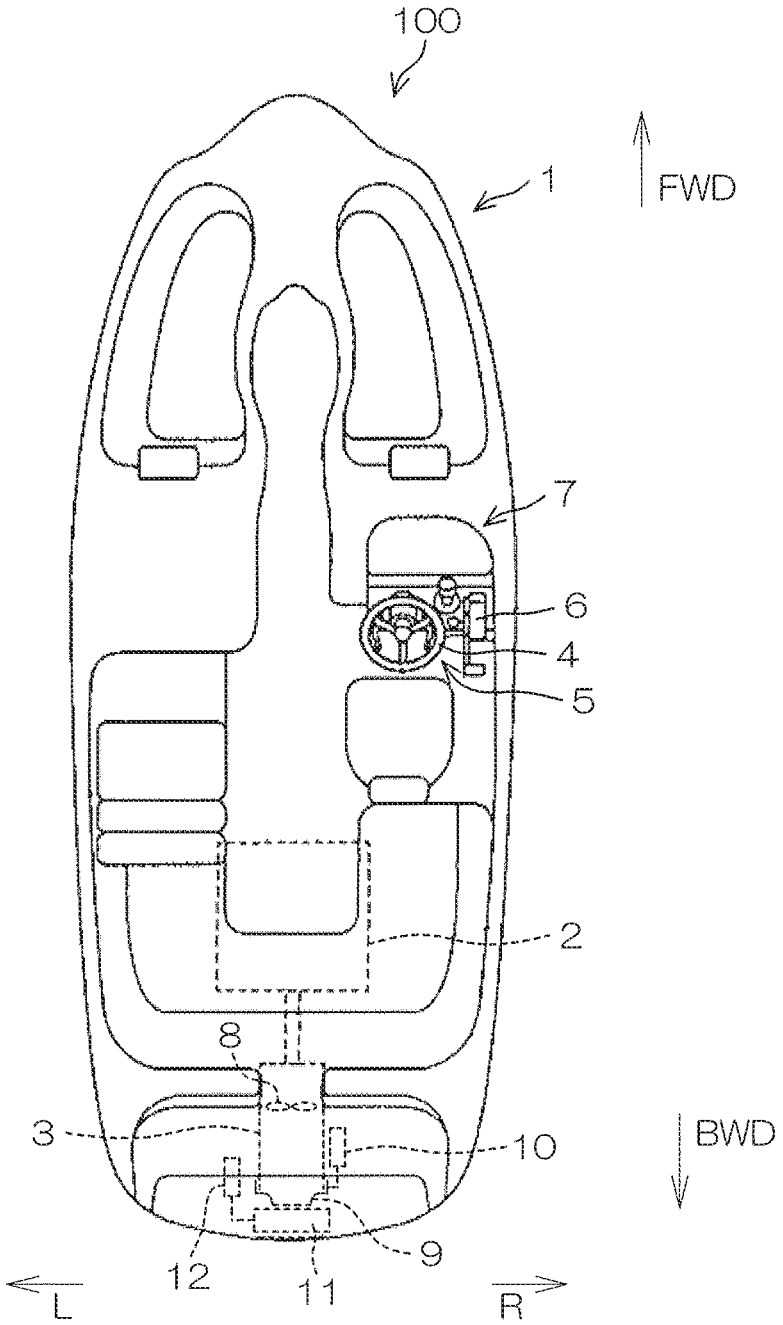
FIG. 1 is a plan view showing the construction of a jet propulsion marine vessel as an example of a marine vessel according to a preferred embodiment of the present invention.

FIG. 1 is a plan view showing the construction of a jet propulsion marine vessel as an example of a marine vessel according to a preferred embodiment of the present invention. In FIG. 1, the forward drive direction (bow direction) of the jet propulsion marine vessel 100 is indicated by an arrow FWD, and the reverse drive direction (stern direction) of the jet propulsion marine vessel 100 is indicated by an arrow BWD. Further, the rightward direction (starboard-side direction) of the jet propulsion marine vessel 100 is indicated by an arrow R, and the leftward direction (port-side direction) of the jet propulsion marine vessel 100 is indicated by an arrow L.

The jet propulsion marine vessel 100 includes a hull 1, an engine 2 provided in the hull 1, and a jet propeller 3 connected to the engine 2. The jet propulsion marine vessel 100 further includes a steering operator 4, a paddle operator 5, and a lever operator 6. The engine 2, the jet propeller 3, the steering operator 4, and the paddle operator 5 define the marine vessel maneuvering system. Further, the engine 2 and the jet propeller 3 define the propulsion device. The engine 2 is an example of the motor. The motor may be an electric motor. The jet propeller 3 is an example of the propulsion unit.

The engine 2 and the jet propeller 3 are disposed in the hull 1. The hull 1 includes an intake port provided in a lower portion thereof to supply water to the jet propeller 3. A console 7 which permits a marine vessel user (user) to maneuver the jet propulsion marine vessel 100 is provided on the hull 1. The steering operator 4, the paddle operator 5, and the lever operator 6 are provided in the console 7.

The jet propeller 3 is driven by the engine 2 to apply a propulsive force to the hull 1. More specifically, the jet propeller 3 is driven by a driving force transmitted from the engine 2 to generate a jet stream by jetting water taken in from the intake port. The jet propeller 3 includes an impeller 8 which is rotated by the engine 2 to generate the jet stream, and a jet nozzle 9 which jets the generated jet stream.

The jet propeller 3 is provided with a nozzle driver 10 arranged to laterally pivot the jet nozzle 9 to change the jetting direction of the jet stream. The nozzle driver 10 is an example of the steering device.

The jet propeller 3 is further provided with a bucket 11 which is able to be located in opposed relation to a spout of the jet nozzle 9 to cover the spout, and a bucket driver 12 which vertically pivots the bucket 11. The bucket driver 12 pivots the bucket 11 between a reverse drive position where the spout of the jet nozzle 9 is covered and a forward drive position where the spout of the jet nozzle 9 is not covered. The bucket 11 and the bucket driver 12 define the forward/reverse drive switch. Where the bucket 11 is located at the forward drive position, the bucket 11 is retracted from the jet stream jetted from the jet nozzle 9 and, therefore, the jet stream is jetted rearward of the hull 1. The counter-action of the jet stream applies a forward drive propulsive force to the hull 1. Where the bucket 11 is located at the reverse drive position, the jet stream jetted from the jet nozzle 9 is deflected into a direction including a forward vector component. Thus, a reverse drive propulsive force is applied to the hull 1.

With the above structural arrangement, the jetting direction of the jet stream jetted from the spout of the jet nozzle 9 is adjustable in any direction within a horizontal plane including anteroposterior directions.

Figure 2:
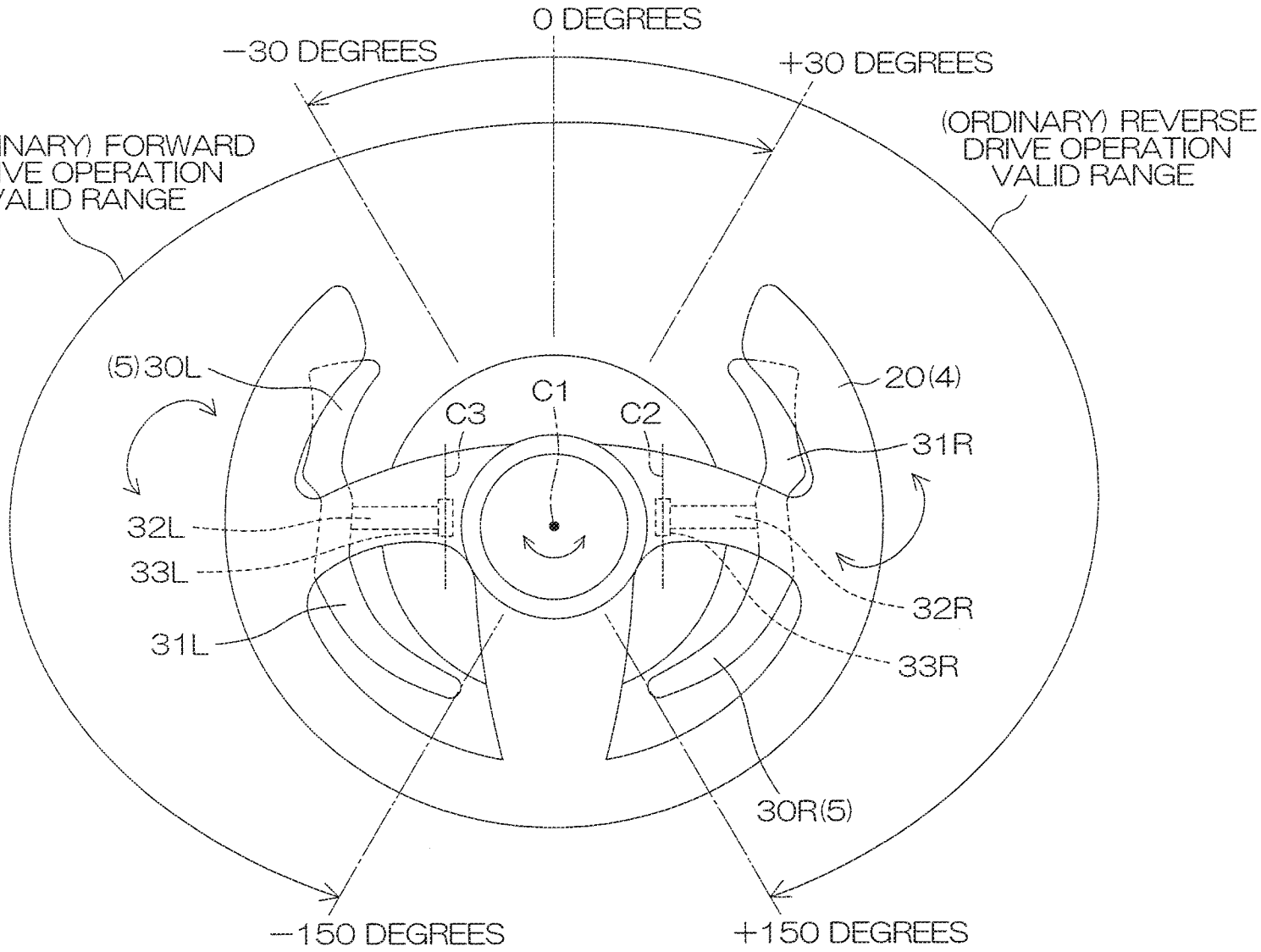
FIG. 2 is a diagram for describing the structures of a steering operator and a paddle operator.
Figure 3:
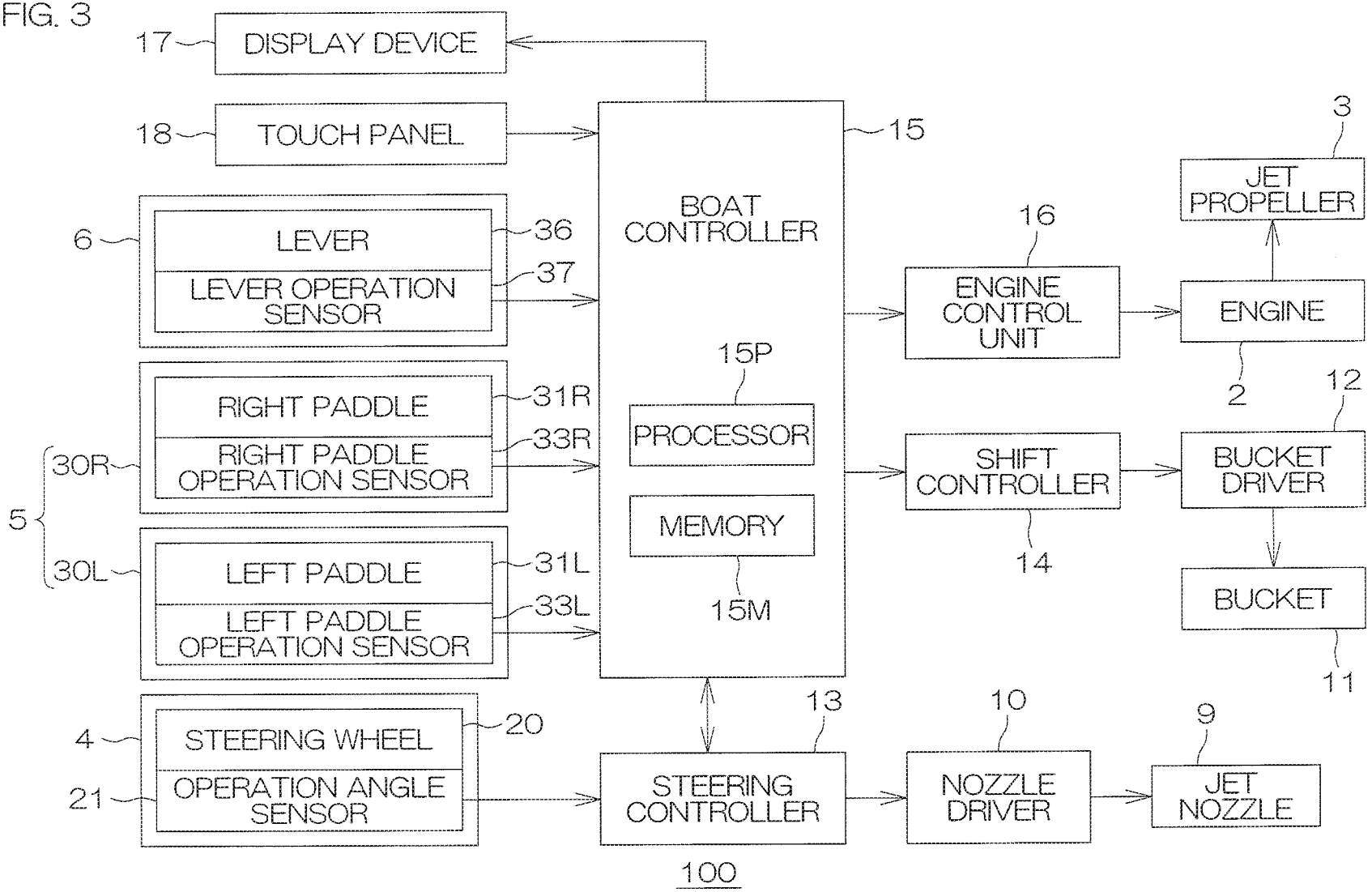
FIG. 3 is a block diagram showing the electrical configuration of the jet propulsion marine vessel.

FIG. 2 is a diagram for describing the structures of the steering operator 4 and the paddle operator 5. FIG. 3 is a block diagram showing the electrical configuration of the jet propulsion marine vessel 100.

The steering operator 4 controls the sailing direction of the jet propulsion marine vessel 100. The steering operator 4 includes a steering wheel 20, and an operation angle sensor 21 which detects the operation angle of the steering wheel 20. The paddle operator 5 is pivoted together with the steering wheel 20.

As shown in FIG. 2, the steering wheel 20 is pivotable about a first pivot axis C1 extending anteroposteriorly of the hull 1. The steering wheel 20 is a steering member that changes the direction of the propulsive force generated by the jet propeller 3. The steering wheel 20 is pivoted clockwise and counterclockwise, such that the nozzle driver 10 laterally pivots the jet nozzle 9. When the steering wheel 20 is pivoted clockwise, the spout of the jet nozzle 9 is steered rightward. When the steering wheel 20 is pivoted counterclockwise, the spout of the jet nozzle 9 is steered leftward. In the present preferred embodiment, the steering wheel 20 has a generally arcuate shape. The steering wheel 20 may have a round shape.

The steering wheel 20 is pivotable about the first pivot axis C1 in an angular range of $\pm\theta$, i.e., in a total angular range of $2\theta$. In the present preferred embodiment, the angle $\theta$ is greater than about 90 degrees and, for example, may be $\theta=150$ degrees, for example. In this case, the steering wheel 20 is pivotable in an angular range of $2\theta=300$ degrees, for example.

In the following description, the operation angle (operation position) of the steering wheel 20 is defined as follows. Where the steering wheel 20 assumes a neutral position, the operation angle (neutral angle) is 0 degrees. The clockwise operation angle with respect to the neutral position as seen from the marine vessel user has a positive value, and the counterclockwise operation angle with respect to the neutral position as seen from the marine vessel user has a negative value. According to the definition of the operation angle, an angular position and a direction about the first pivot axis C1 are defined as follows. As viewed from the user who operates the steering wheel 20, an upward direction extending upward from the first pivot axis C1 (the direction of a center line dividing the steering wheel 20 into right and left halves) is defined as a zero-degree direction (reference direction). The angular position and the direction about the first pivot axis C1 are defined such that a clockwise angle with respect to the zero-degree direction is defined as a positive angle and a counterclockwise angle with respect to the zero-degree direction is defined as a negative angle.

The operation angle sensor 21 detects the operation angle of the steering wheel 20. As shown in FIG. 3, an output signal of the operation angle sensor 21 is inputted to a steering controller 13. According to the output signal of the operation angle sensor 21, the steering controller 13 drives the nozzle driver 10 to control the steering angle of the jet nozzle 9.

As shown in FIGS. 1 and 2, the paddle operator 5 is attached to the steering wheel 20, and is operated by the marine vessel user to control a throttle of the engine 2 and to control the position (shift) of the bucket 11. The paddle operator 5 includes a first operator and a second operator, i.e., a right operator 30R and a left operator 30L, which are pivotable together with the steering wheel 20 about the first pivot axis C1.

With the steering wheel 20 assuming the neutral position (see FIG. 2), the right operator 30R is located on a right side of the first pivot axis C1. More specifically, where the operation angle is 0 degrees, the right operator 30R is located at an angular position of +90 degrees, for example. More generally, the right operator 30R is located at an angular position of a given operation angle plus 90 degrees. The right operator 30R is designed to be operated by the right hand of the marine vessel user.

With the steering wheel 20 assuming the neutral position (see FIG. 2), the left operator 30L is located on a left side of the first pivot axis C1. More specifically, where the operation angle is 0 degrees, the left operator 30L is located at an angular position of −90 degrees, for example. More generally, the left operator 30L is located at an angular position of a given operation angle minus 90 degrees. The left operator 30L is designed to be operated by the left hand of the marine vessel user. Where the steering wheel 20 assumes the neutral position (where the operation angle is the neutral angle), the right operator 30R and the left operator 30L are located laterally symmetrically with respect to the first pivot axis C1.

According to the operation of the right operator 30R, the throttle of the engine 2 and the bucket driver 12 are controlled. Specifically, when the right operator 30R is operated, the bucket driver 12 is controlled to locate the bucket 11 at the forward drive position. Further, the throttle opening degree of the engine 2 is controlled according to the operation amount of the right operator 30R. Therefore, the right operator 30R is an example of the forward drive operator which is operated to generate the forward drive propulsive force from the jet propeller 3 and control the magnitude of the propulsive force.

Similarly, the throttle of the engine 2 and the bucket driver 12 are controlled according to the operation of the left operator 30L. Specifically, when the left operator 30L is operated, the bucket driver 12 is controlled to locate the bucket 11 at the reverse drive position. Further, the throttle opening degree of the engine 2 is controlled according to the operation amount of the left operator 30L. Therefore, the left operator 30L is operated to generate the reverse drive propulsive force from the jet propeller 3 and control the magnitude of the propulsive force. That is, the left operator 30L is an example of the reverse drive operator which is operated to decelerate the jet propulsion marine vessel 100 or sail the jet propulsion marine vessel 100 rearward.

The right operator 30R and the left operator 30L are arranged to be pivoted together with the steering wheel 20 about the first pivot axis C1. The right operator 30R includes a right paddle 31R, a connector 32R, and a right paddle operation sensor 33R. The connector 32R connects the right paddle 31R pivotally to a back surface of a right portion of the steering wheel 20. Thus, the right paddle 31R is pivotable about a second pivot axis C2 extending generally perpendicularly to the first pivot axis C1, and the pivot angle of the right paddle 31R is detected by the right paddle operation sensor 33R. The right paddle 31R is biased away from the steering wheel 20 and, when it is not operated, is located farthest from the steering wheel 20. By operating the right paddle 31R toward the steering wheel 20 (toward the marine vessel user), the engine 2 is operated in a throttle opening direction. By operating the right paddle 31R away from the steering wheel 20, the engine 2 is operated in a throttle closing direction. That is, the engine 2 is able to be accelerated by gripping the right paddle 31R.

Similarly, the left operator 30L includes a left paddle 31L, a connector 32L, and the left paddle operation sensor 33L. The connector 32L connects the left paddle 31L pivotally to a back surface of a left portion of the steering wheel 20. Thus, the left paddle 31L is pivotable about a third pivot axis C3 extending generally perpendicularly to the first pivot axis C1, and the pivot angle of the left paddle 31L is detected by the left paddle operation sensor 33L. The left paddle 31L is biased away from the steering wheel 20 and, when it is not operated, is located farthest from the steering wheel 20. By operating the left paddle 31L toward the steering wheel 20 (toward the marine vessel user), the jet propulsion marine vessel 100 is decelerated in the forward sailing direction or is sailed rearward. By operating the left paddle 31L toward the steering wheel 20, the bucket 11 is located at the reverse drive position. By moving the left paddle 31L further toward the steering wheel 20, the engine 2 is operated in the throttle opening direction. When the left paddle 31L is operated away from the steering wheel 20, the engine 2 is operated in the throttle closing direction. By operating the left paddle 31L further away from the steering wheel 20, the bucket 11 is retracted to the forward drive position.

In the present preferred embodiment, when the right operator 30R and the left operator 30L are operated, the marine vessel speed is limited to a low speed that is not higher than a predetermined speed level. Further, when the marine vessel speed is a high speed that is higher than the predetermined speed level, the operation of the right operator 30R and the left operator 30L is disabled.

Like the paddle operator 5, the lever operator 6 performs a marine vessel maneuvering operation. That is, the lever operator 6 is an operation device that controls the throttle opening degree of the engine 2, and switches the propulsive force between a forward drive direction and a reverse drive direction. The lever operator 6 includes a lever 36 and a lever operation sensor 37. The lever 36 is operated to be moved by the marine vessel user, and the position of the lever 36 is detected by the lever operation sensor 37. An electrical signal corresponding to the detected lever position is sent to a boat controller 15. According to the electrical signal, the boat controller 15 controls the throttle of the engine 2, and controls the bucket driver 12.

Mainly referring to FIG. 3, the electrical configuration of the jet propulsion marine vessel 100 will be described. The jet propulsion marine vessel 100 includes the boat controller 15, an engine control unit 16, a shift controller 14, the steering controller 13, the nozzle driver 10, the bucket driver 12, the steering operator 4, the paddle operator 5, the lever operator 6, a display device 17, and a touch panel 18 as controllers. The boat controller 15 may include, for example, a microcomputer including a processor 15P (CPU) and a memory 15M (e.g., ROM, RAM, flash memory, and the like). A program to be executed by the processor 15P is stored in the memory 15M. The processor 15P executes the program, such that the boat controller 15 performs various control processes based on detection signals inputted from the various sensors provided in the jet propulsion marine vessel 100.

The engine control unit 16 controls the engine 2. More specifically, the engine control unit 16 controls the throttle opening degree of the engine 2 according to a command signal from the boat controller 15 to control the output of the engine 2.

The steering operator 4 includes the operation angle sensor 21, which detects the pivot angle (operation angle) of the steering wheel 20. The output signal of the operation angle sensor 21 is inputted to the steering controller 13. The steering controller 13 controls the nozzle driver 10 according to the output signal of the operation angle sensor 21. The boat controller 15 communicates with the steering controller 13 to acquire information of the operation angle detected by the operation angle sensor 21.

The nozzle driver 10 includes a nozzle actuator which generates a driving force to laterally move the jet nozzle 9. The nozzle actuator may be an electric actuator including an electric motor. The steering controller 13 controls the nozzle actuator of the nozzle driver 10. The steering controller 13 may include a driver circuit which drives the nozzle actuator, and a microcomputer which inputs a control signal to the driver circuit. The steering controller 13 drives the nozzle actuator, thus laterally pivoting the jet nozzle 9.

The bucket driver 12 includes a bucket actuator which generates a driving force to move the bucket 11. The bucket actuator may be an electric actuator including an electric motor. The shift controller 14 may include a driver circuit which drives the bucket actuator, and a microcomputer which inputs a control signal to the driver circuit. The shift controller 14 drives the bucket actuator, thus moving the bucket 11 between the forward drive position and the reverse drive position.

The right paddle operation sensor 33R and the left paddle operation sensor 33L include, for example, position sensors which detect the operation positions of the respective paddles 31R and 31L. Output signals of the right paddle operation sensor 33R and the left paddle operation sensor 33L are inputted to the boat controller 15. The boat controller 15 controls the bucket driver 12 according to the output signals of the right paddle operation sensor 33R and the left paddle operation sensor 33L. Further, the boat controller 15 applies an output adjustment command to the engine control unit 16 according to the output signals of the right paddle operation sensor 33R and the left paddle operation sensor 33L. The engine control unit 16 controls the throttle opening degree according to the output adjustment command, thus adjusting the output (rotation speed) of the engine 2.

The lever operation sensor 37 of the lever operator 6 includes, for example, a position sensor which detects the operation position of the lever 36. An output signal of the lever operation sensor 37 is inputted to the boat controller 15. The boat controller 15 controls the bucket driver 12 according to the output signal of the lever operation sensor 37. Further, the boat controller 15 applies an output adjustment command to the engine control unit 16 according to the output signal of the lever operation sensor 37. The engine control unit 16 controls the throttle opening degree according to the output adjustment command, thus adjusting the output (rotation speed) of the engine 2.

The display device 17 may be a liquid crystal display device provided on the console 7 (see FIG. 1). The touch panel 18 is provided on a display screen of the display device 17. The marine vessel user operates the touch panel 1 to select a marine vessel manipulation operation to be performed by the paddle operator 5 (specifically, by selecting the shift and adjusting the output) or a marine vessel manipulation operation to be performed by the lever operator 6. The manipulation operation by the paddle operator 5 and the manipulation operation by the lever operator 6 may be selected by operating the paddle operator 5 and the lever operator 6, respectively, instead of operating the touch panel 18.

Figure 4:
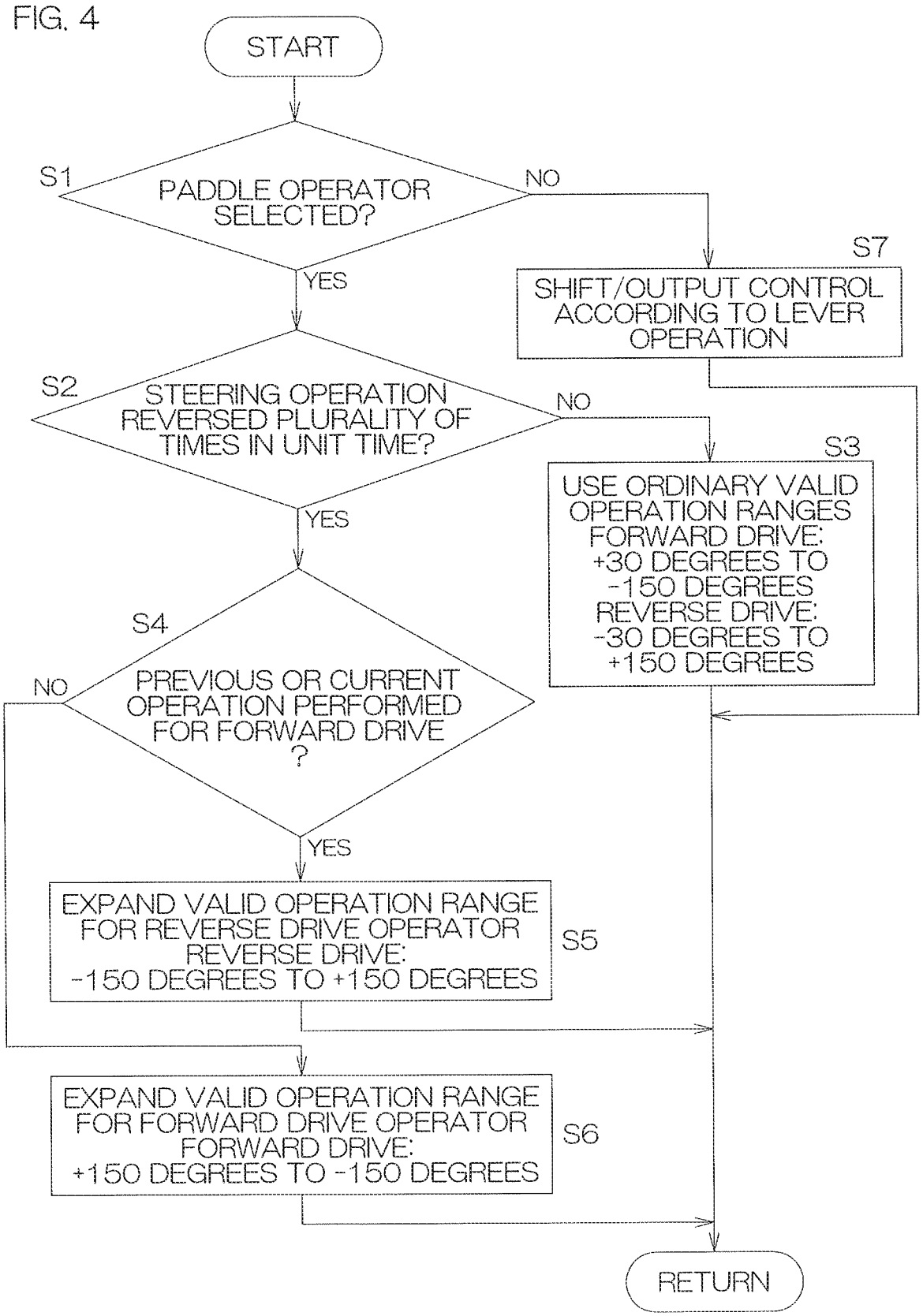
FIG. 4 is a flowchart for describing a first exemplary control process to variably set valid operation angle ranges for the paddle operator.

FIG. 4 is a flowchart for describing a first exemplary control process to variably set valid operation angle ranges for the paddle operator 5, mainly showing a control process to be performed by the boat controller 15. The boat controller 15 repeats this control process in a predetermined control cycle.

The boat controller 15 determines which of the lever operator 6 and the paddle operator 5 is selected (Step S1). If the lever operator 6 is selected (NO in Step S1), the following control process is not performed, but the control process is performed according to the output signal of the lever operation sensor 37 (Step S7). If the paddle operator 5 is selected (YES in Step S1), the boat controller 15 acquires information of the operating direction of the steering wheel 20 based on the operation angle information. Thus, the boat controller 15 functions as the operating direction acquirer. The boat controller 15 determines whether the operating direction of the steering wheel 20 is reversed a plurality of times in a unit time (e.g., 5 seconds) (Step S2). If this determination result is negative, the boat controller 15 sets the valid operation angle ranges for the paddle operator 5 to ordinary ranges (ordinary valid operation angle ranges) (Step S3).

Figures 5A, 5B, 5C, 5D, 5E:
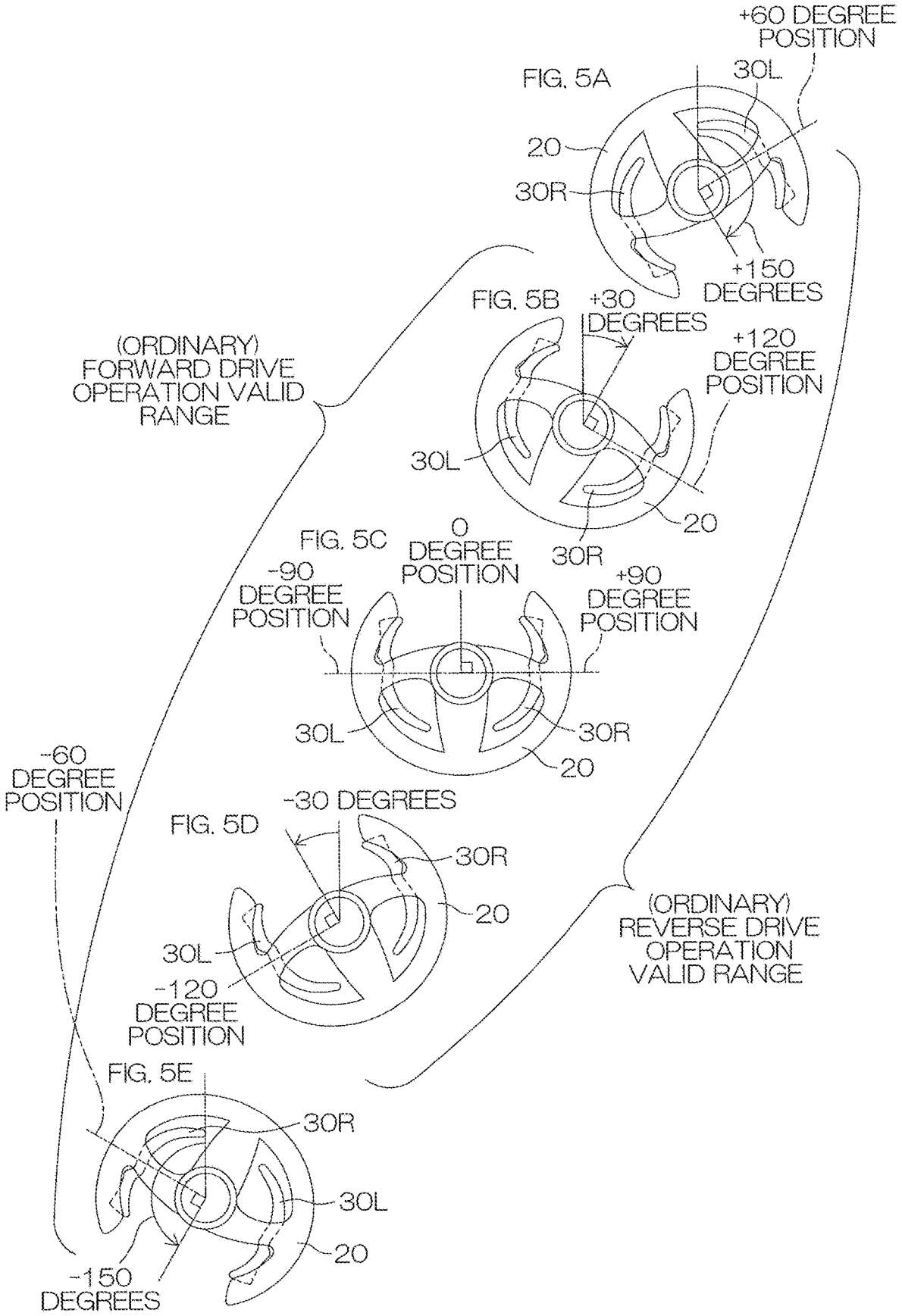
FIGS. 5A to 5E are diagrams showing the positions of the steering wheel and the paddle operator at various operation angles.

Specifically, the ordinary valid operation angle range (forward drive operation valid range) for the right operator 30R may be an operation angle range from, for example, +30 degrees through 0 degree to −150 degrees (see FIG. 2, and FIGS. 5B to 5E). That is, the ordinary valid operation angle range for the right operator 30R includes an operation angle range between 0 degree and +30 degrees, for example, on the clockwise side with respect to the neutral position (see FIG. 5C), and an operation angle range between 0 degree and −150 degrees, for example, on the counterclockwise side with respect to the neutral position. When the operation angle is +30 degrees, as shown in FIG. 5B, the right operator 30R is located at an angular position of +120 (=+30+90) degrees. When the operation angle is −150 degrees, as shown in FIG. 5E, the right operator 30R is located at an angular position of −60 (=−150+90) degrees. Further, the ordinary valid operation angle range (reverse drive operation valid range) for the left operator 30L may be, for example, a range from −30 degrees through 0 degree to +150 degrees (see FIG. 2, and FIGS. 5A to 5D). That is, the ordinary valid operation angle range for the left operator 30L includes an operation angle range between 0 degree and −30 degrees, for example, on the counterclockwise side with respect to the neutral position (see FIG. 5C), and an operation angle range between 0 degree and +150 degrees, for example, on the clockwise side with respect to the neutral position. When the operation angle is −30 degrees, as shown in FIG. 5D, the left operator 30L is located at an angular position of −120 (=−30−90) degrees. When the operation angle is +150 degrees, as shown in FIG. 5A, the left operator 30L is located at an angular position of +60 (=+150−90) degrees. Thus, the operation of the right operator 30R and the operation of the left operator 30L are each validly accepted in an operation angle range of 180 degrees (the same operation angle range). Where the operation angle falls outside the valid operation angle ranges, the boat controller 15 disables the operation of the paddle operator 5.

As can be understood from FIGS. 5A to 5E, particularly, where the marine vessel sails at a high speed, it is not necessarily desired to operate the right operator 30R and the left operator 30L outside the ordinary valid operation angle ranges.

If the operating direction of the steering wheel 20 is reversed a plurality of times in the unit time (YES in Step S2), the boat controller 15 performs a control operation to expand the valid operation angle ranges (in other words, narrow the invalid operation angle ranges). Where the operating direction of the steering wheel 20 is reversed a plurality of times in the unit time, this means that the steering direction is frequently changed. Specifically, the steering wheel 20 is operated in this way when docking and undocking. When docking and undocking, the steering direction and the propulsion direction are frequently changed. Therefore, the right operator 30R and the left operator 30L are alternately operated. In this case, the marine vessel maneuvering operation is facilitated by expanding the operation angle ranges in which the paddle operation is accepted.

More specifically, the boat controller 15 determines whether an operator (the right operator 30R or the left operator 30L) previously operated or currently operated is the right operator 30R (forward drive operator) (Step S4). If the determination result is positive, the boat controller 15 expands the valid operation angle range for the left operator 30L (reverse drive operator) which is expected to be operated next (Step S5). Specifically, the valid operation angle range is expanded from the ordinary valid operation angle range (from −30 degrees through 0 degree to +150 degrees) for the left operator 30L by a predetermined counterclockwise angle (e.g., 120 degrees). In this case, the total valid operation angle range (reverse drive operation valid range) for the left operator 30L is from −150 degrees through 0 degree to +150 degrees. That is, the operation of the left operator 30L is enabled in the operation angle range shown in FIGS. 5A to 5E.

If the operator previously operated or currently operated is the left operator 30L (reverse drive operator) (NO in Step S4), on the other hand, the boat controller 15 expands the valid operation angle range for the right operator 30R (forward drive operator) which is expected to be operated next (Step S6). Specifically, the valid operation angle range is expanded from the ordinary valid operation angle range (from +30 degrees through 0 degree to −150 degrees) for the right operator 30R by a predetermined clockwise angle (e.g., 120 degrees). In this case, the total valid operation angle range (forward drive operation valid range) for the right operator 30R is from +150 degrees through 0 degree to −150 degrees. That is, the operation of the right operator 30R is enabled in the operation angle range shown in FIGS. 5A to 5E.

When docking and undocking, as described above, the right operator 30R and the left operator 30L are alternately operated, so that the valid operation angle ranges for the right operator 30R and the left operator 30L are both expanded. Therefore, the operation of the right operator 30R and the operation of the left operator 30L are enabled in an operation angle range between −150 degrees and +150 degrees, for example.

When docking and undocking, the operation of the paddle operator 5 is thus accepted in the wider range and, therefore, the marine vessel user is able to switch the direction of the propulsive force between the forward drive direction and the reverse drive direction by operating the right operator 30R and the left operator 30L while pivoting the steering wheel 20 by a greater angle. This facilitates the marine vessel maneuvering operation when docking and undocking. Further, the operation of the paddle operator 5 is validly accepted to improve the maneuvering feeling.

Figure 6:
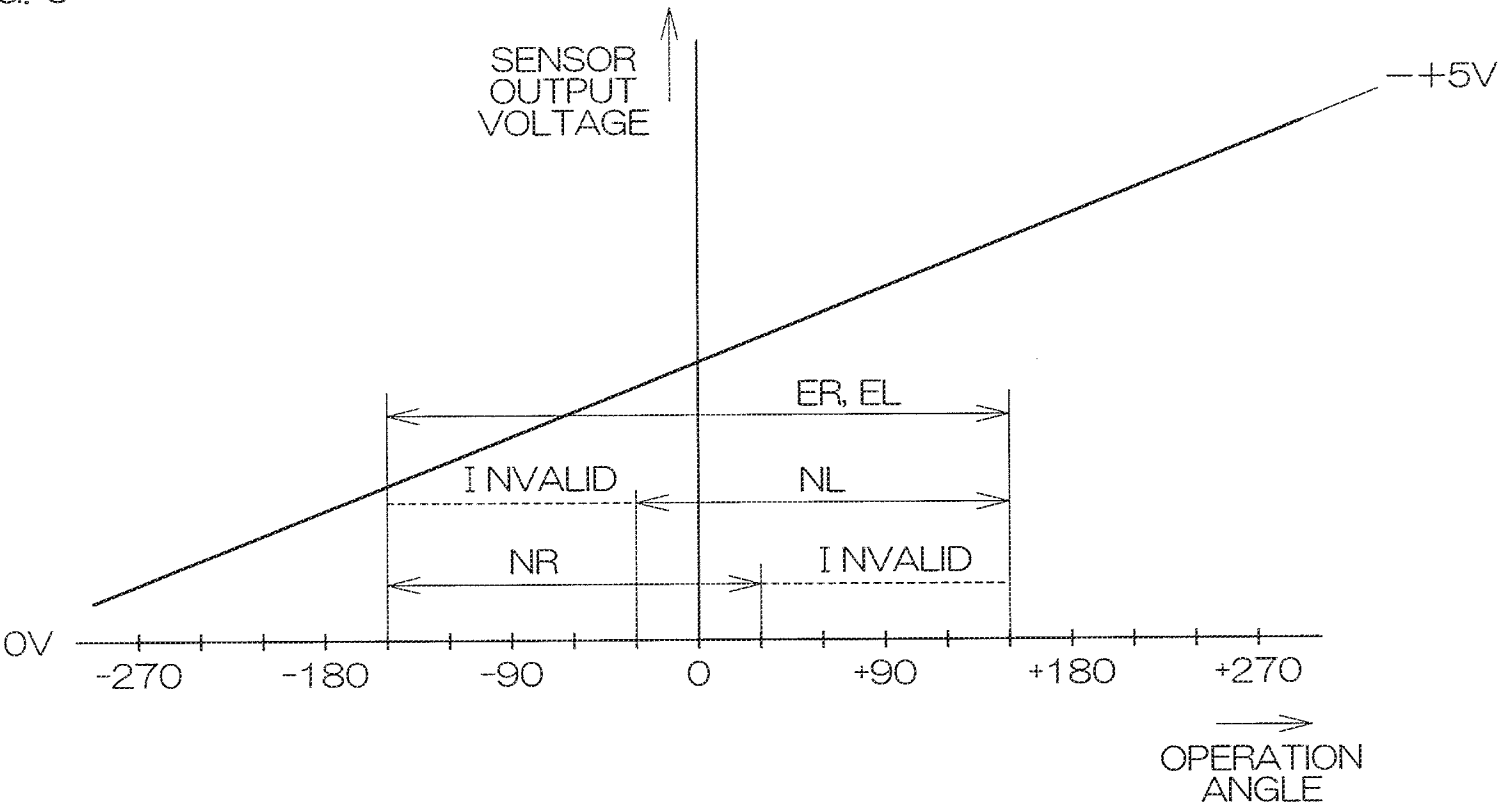
FIG. 6 is a diagram showing the output voltage characteristic of an operation angle sensor and the valid operation angle ranges in the first exemplary control process.

FIG. 6 is a diagram showing a relationship between the output voltage of the operation angle sensor 21 and the operation angle, and further showing the valid operation angle ranges. The operation angle sensor 21 generates a voltage of, for example, 0 V to 5 V. When the steering wheel 20 is located at the neutral position (at an operation angle of 0 degrees), the operation angle sensor 21 generates a median voltage (e.g., 2.5 V). The ordinary valid operation angle range NR for the right operator 30R is from +30 degrees to −150 degrees. When docking and undocking, the valid operation angle range ER for the right operator 30R is expanded to a range between +150 degrees and −150 degrees. The ordinary valid operation angle range NL for the left operator 30L is from −30 degrees to +150 degrees. When docking and undocking, the valid operation angle range EL for the left operator 30L is expanded to a range between −150 degrees and +150 degrees. Where the steering wheel 20 has a full operation angle range between −150 degrees and +150 degrees, the paddle operation is accepted in the full operation angle range.

Figure 7:
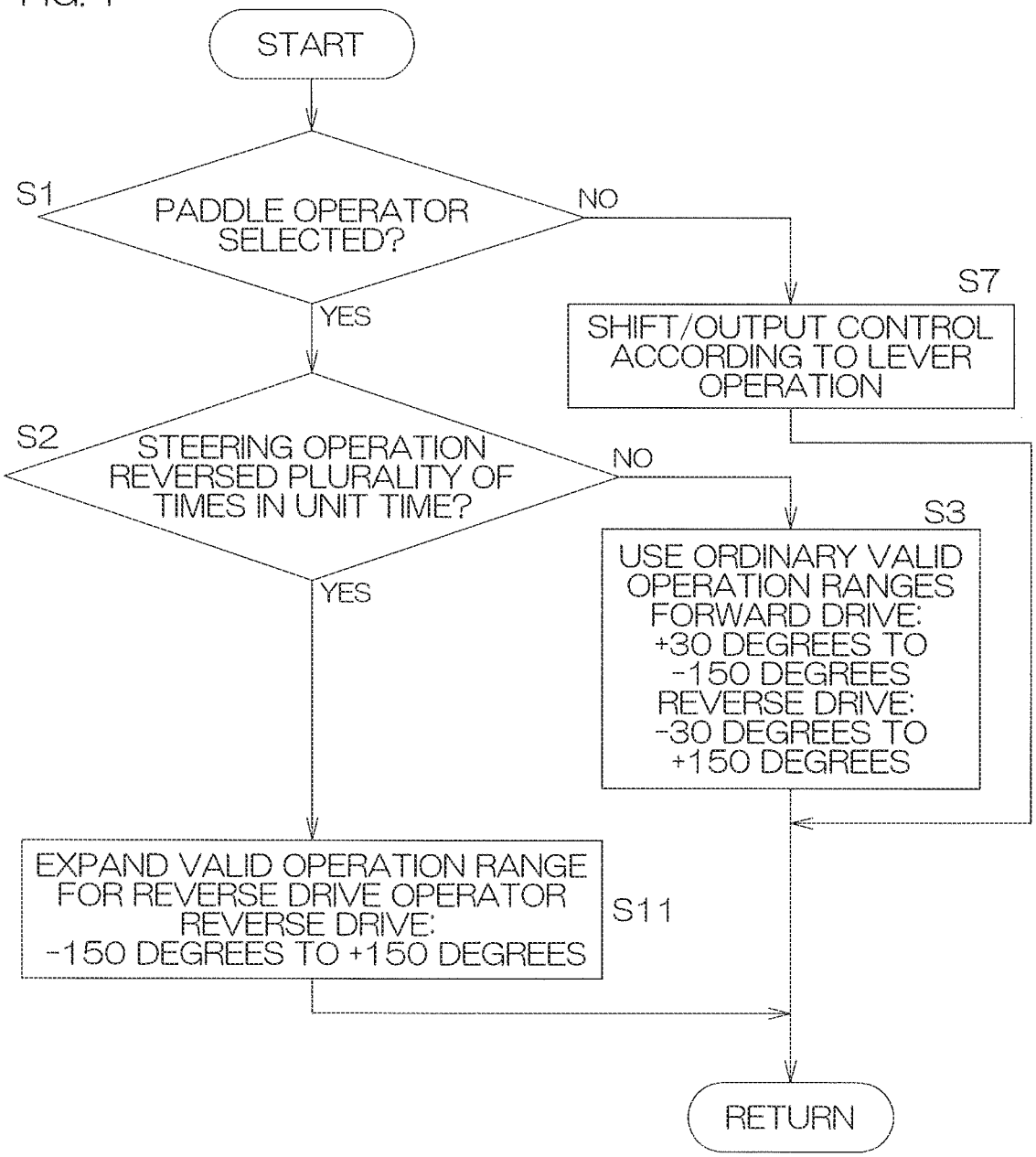
FIG. 7 is a flowchart for describing a second exemplary control process to variably set the valid operation angle ranges for the paddle operator.

FIG. 7 is a flowchart for describing a second exemplary control process to variably set the valid operation angle ranges for the paddle operator 5, mainly showing a control process to be performed by the boat controller 15. The boat controller 15 repeats this control process in a predetermined control cycle. In FIG. 7, steps to be performed in the same manner as in FIG. 4 will be denoted by the same reference characters as in FIG. 4.

The boat controller 15 determines which of the lever operator 6 and the paddle operator 5 is selected (Step S1). If the lever operator 6 is selected (NO in Step S1), the following control process is not performed, but the control process is performed according to the output signal of the lever operation sensor 37 (Step S7). If the paddle operator 5 is selected (YES in Step S1), the boat controller 15 determines whether the operating direction of the steering wheel 20 is reversed a plurality of times in a unit time (e.g., 5 seconds) (Step S2). If this determination result is negative, the boat controller 15 sets the valid operation ranges for the paddle operator 5 to the ordinary ranges (ordinary valid operation angle ranges) (Step S3). In this case, this operation is performed in the same manner as in the first exemplary control process.

If the operating direction of the steering wheel 20 is reversed a plurality of times in the unit time (YES in Step S2), the boat controller 15 performs a valid operation angle range expanding control operation (in other words, an invalid operation angle range narrowing control operation). In the second exemplary control process, the valid operation angle range for the left operator 30L (reverse drive operator) is expanded, while the valid operation angle range for the right operator 30R (forward drive operator) is kept as it is. Specifically, the valid operation angle range is expanded from the ordinary valid operation angle range (−30 degrees to +150 degrees) for the left operator 30L by a predetermined counterclockwise angle (e.g., 120 degrees). In this case, the valid operation angle range (reverse drive operation valid range) for the left operator 30L is expanded to a range between −150 degrees and +150 degrees.

Figure 8:
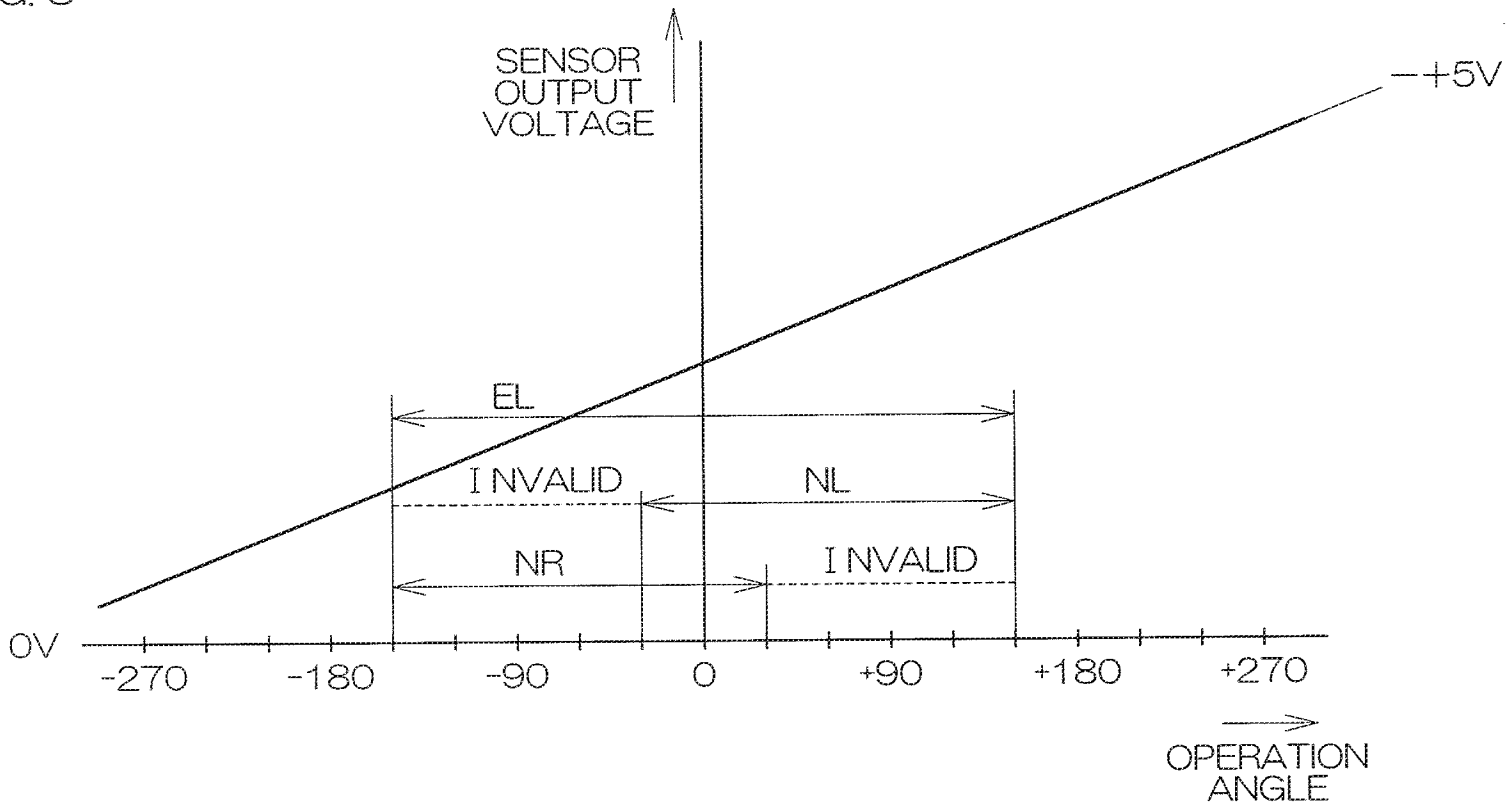
FIG. 8 is a diagram showing the output voltage characteristic of the operation angle sensor and the valid operation angle ranges in the second exemplary control process.

FIG. 8 is a diagram showing a relationship between the output voltage of the operation angle sensor 21 and the operation angle, and further showing the valid operation angle ranges. The valid operation angle range NR (forward drive operation valid range) for the right operator 30R is constantly from +30 degrees to −150 degrees. On the other hand, the ordinary valid operation angle range NL (reverse drive operation valid range) for the left operator 30L is from −30 degrees to +150 degrees. When docking and undocking, a valid operation angle range EL (reverse drive operation valid range) is expanded to a range between −150 degrees and +150 degrees. Where the steering wheel 20 has a full operation angle range between −150 degrees and +150 degrees, the operation of the left operator 30L is accepted in the full operation angle range when docking and undocking.

When docking and undocking, the reverse drive propulsive force is frequently adjusted. Therefore, the marine vessel maneuverability and the maneuvering feeling is improved when docking and undocking by expanding the valid operation angle range for the left operator 30L in the reverse drive operation.

Figure 9:
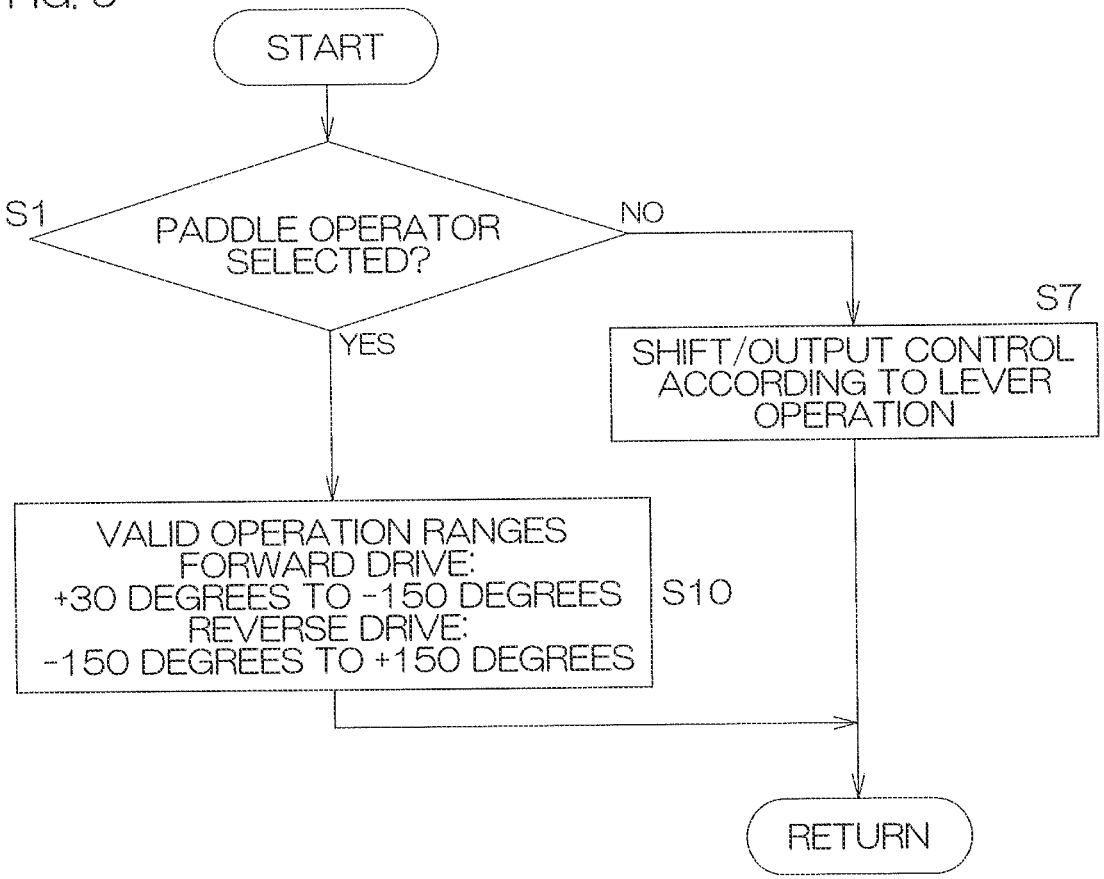
FIG. 9 is a flowchart for describing a third exemplary control process to control the valid operation angle ranges for the paddle operator.

FIG. 9 is a flowchart for describing a third exemplary control process to control the valid operation angle ranges for the paddle operator 5, mainly showing a control process to be performed by the boat controller 15. The boat controller 15 repeats this control process in a predetermined control cycle. In FIG. 9, steps to be performed in the same manner as in FIG. 7 will be denoted by the same reference characters as in FIG. 7.

The boat controller 15 determines which of the lever operator 6 and the paddle operator 5 is selected (Step S1). If the lever operator 6 is selected (NO in Step S1), the following control process is not performed, but the control process is performed according to the output signal of the lever operation sensor 37 (Step S7). If the paddle operator 5 is selected (YES in Step S1), the boat controller 15 sets the valid operation ranges for the paddle operator 5 (Step S10).

Specifically, the valid operation angle range (forward drive operation valid range) for the right operator 30R (forward drive operator) is set to a range of 180 degrees between +30 degrees and −150 degrees. On the other hand, the valid operation angle range (reverse drive operation valid range) for the left operator 30L (reverse drive operator) is set to a range of 300 degrees between −150 degrees and +150 degrees. The boat controller 15 disables the operation of the paddle operator 5 outside these valid operation angle ranges.

Where the paddle operator 5 is mainly used for the marine vessel maneuvering operation when docking and undocking, the marine vessel maneuverability and the maneuvering feeling when docking and undocking is improved by expanding the valid operation angle range for the left operator 30L which is operated to adjust the reverse drive propulsive force.

Figure 10:
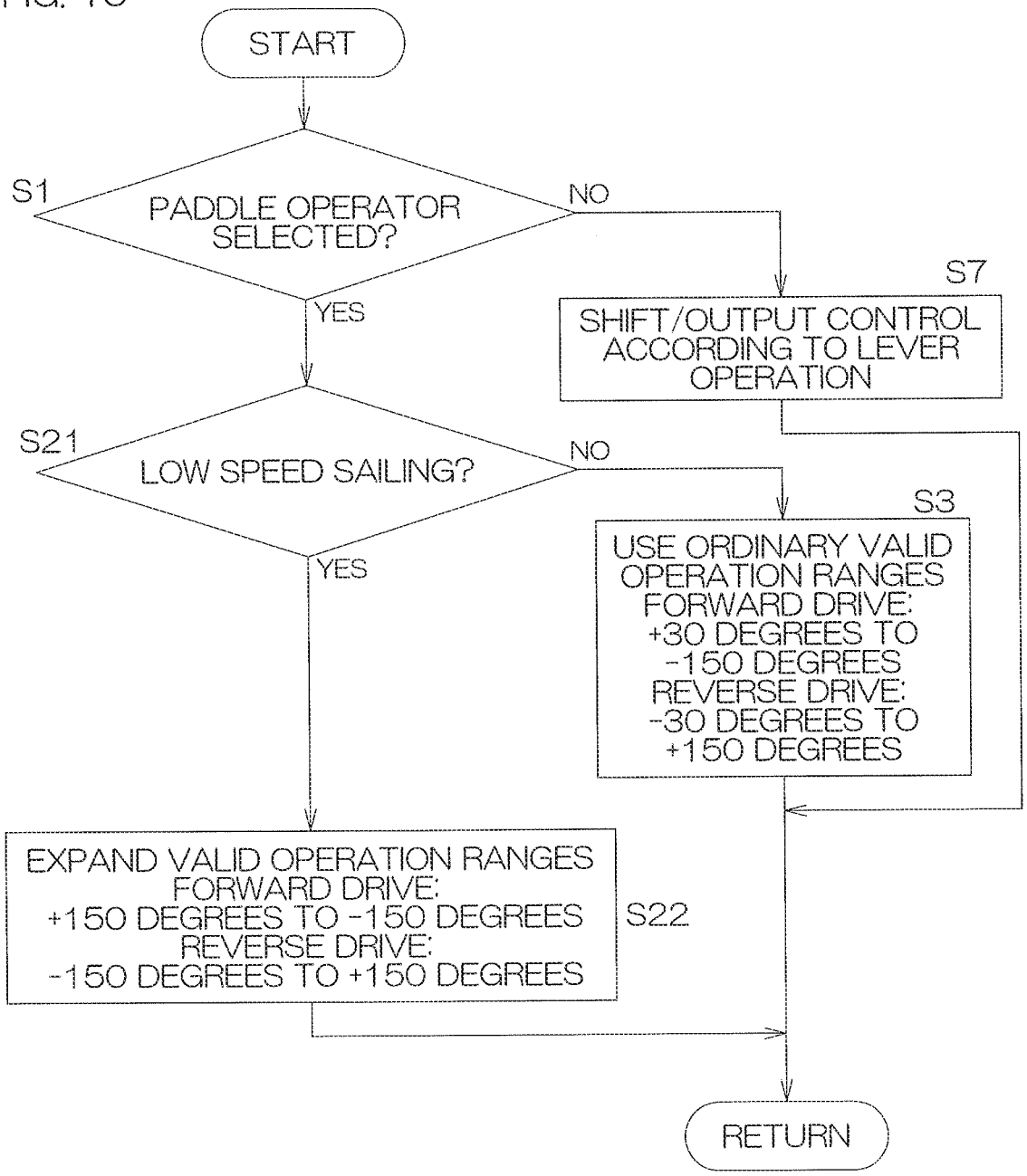
FIG. 10 is a flowchart for describing a fourth exemplary control process to variably set the valid operation angle ranges for the paddle operator.

FIG. 10 is a flowchart for describing a fourth exemplary control process to variably set the valid operation angle ranges for the paddle operator, mainly showing a control process to be performed by the boat controller 15. The boat controller 15 repeats this control process in a predetermined control cycle. In FIG. 10, steps to be performed in the same manner as in FIG. 4 will be denoted by the same reference characters as in FIG. 4.

The boat controller 15 determines which of the lever operator 6 and the paddle operator 5 is selected (Step S1). If the lever operator 6 is selected (NO in Step S1), the following control process is not performed, but the control process is performed according to the output signal of the lever operation sensor 37 (Step S7). If the paddle operator 5 is selected (YES in Step S1), the boat controller 15 determines whether the marine vessel is in a low speed sailing state (Step S21). This determination may be based on whether the marine vessel speed is less than about 10 km/h, for example, or whether the engine rotation speed (motor rotation speed) is less than about 3,000 rpm, for example. The marine vessel speed may be measured by a marine vessel speed sensor, or may be estimated based on the engine rotation speed.

If this determination result is negative (NO in Step S21), the boat controller 15 sets the valid operation angle ranges for the paddle operator 5 to the ordinary ranges (ordinary valid operation angle ranges) (Step S3). In this case, the operation is performed in the same manner as in the first exemplary control process.

If the boat controller 15 determines that the marine vessel is in the low speed sailing state (YES in Step S21), the boat controller 15 performs a control operation to expand the valid operation angle ranges (in other words, narrow the invalid operation angle ranges) (Step S22). More specifically, the valid operation angle ranges (forward drive operation valid range and reverse drive operation valid range) for the right operator 30R and the left operator 30L are expanded. For example, the operation of the right operator 30R and the operation of the left operator 30L are both enabled in an operation angle range between −150 degrees and +150 degrees. The expanded valid operation angle range for the right operator 30R and the expanded valid operation angle range for the left operator 30L may be different from each other.

Figure 11:
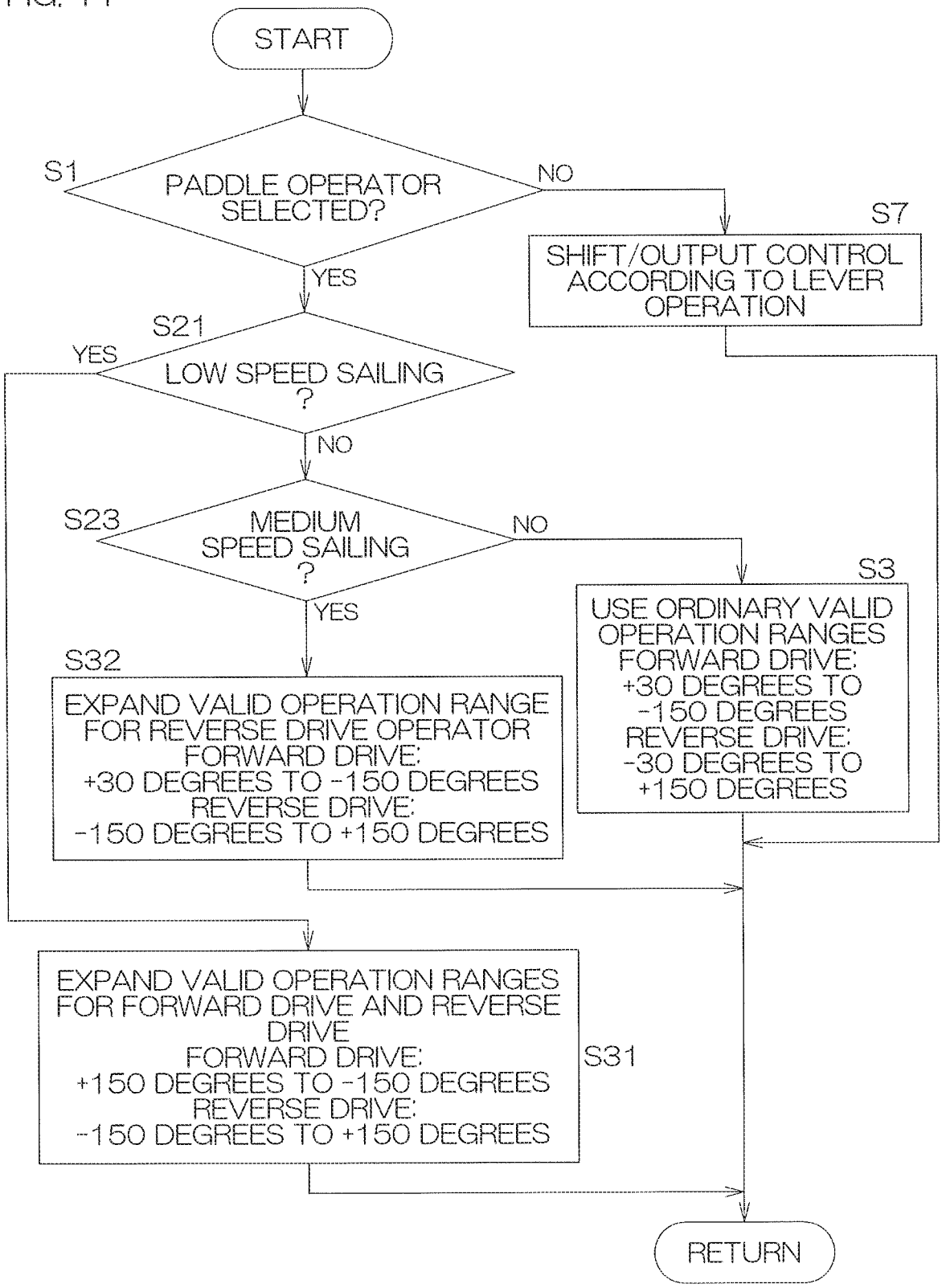
FIG. 11 is a flowchart for describing a fifth exemplary control process to variably set the valid operation angle ranges for the paddle operator.

FIG. 11 is a flowchart for describing a fifth exemplary control process to variably set the valid operation angle ranges for the paddle operator 5, mainly showing a control process to be performed by the boat controller 15. The boat controller 15 repeats this control process in a predetermined control cycle. In FIG. 11, steps to be performed in the same manner as in FIG. 10 will be denoted by the same reference characters as in FIG. 10.

The boat controller 15 determines which of the lever operator 6 and the paddle operator 5 is selected (Step S1). If the lever operator 6 is selected (NO in Step S1), the following control process is not performed, but the control process is performed according to the output signal of the lever operation sensor 37 (Step S7). If the paddle operator 5 is selected (YES in Step S1), the boat controller 15 determines whether the marine vessel is in a low speed sailing state (Step S21). This determination may be based on whether the marine vessel speed is less than about 10 km/h, for example, or whether the engine rotation speed is less than about 3,000 rpm, for example. The marine vessel speed may be measured by a marine vessel speed sensor, or may be estimated based on the engine rotation speed.

If the determination result is negative (NO in Step S21), the boat controller 15 determines whether the marine vessel is in a medium speed sailing state (Step S23). This determination may be based on whether the marine vessel speed is not less than about 10 km/h, for example, and less than about 20 km/h, for example, or whether the engine rotation speed is not less than about 3,000 rpm, for example, and less than about 5,000 rpm, for example.

If this determination result is also negative (NO in Step S23), i.e., if the marine vessel is in a high speed sailing state (ordinary sailing state), the boat controller 15 sets the valid operation angle ranges for the paddle operator 5 to the ordinary ranges (Step S3).

If the boat controller 15 determines that the marine vessel is in the low speed sailing state (YES in Step S21), the boat controller 15 performs a control operation to expand the valid operation ranges for the paddle operator 5. More specifically, the valid operation angle ranges (forward drive operation valid range and reverse drive operation valid range) for the right operator 30R and the left operator 30L are both expanded (Step S31), For example, the operation of the right operator 30R and the operation of the left operator 30L are both enabled in an operation angle range between −150 degrees and +150 degrees. However, the expanded valid operation angle range for the right operator 30R and the expanded valid operation angle range for the left operator 30L may be different from each other.

If the boat controller 15 determines that the marine vessel is in the medium speed sailing state (YES in Step S23), the boat controller 15 performs a valid operation angle range expanding control operation for the paddle operator 5. In the fifth exemplary control process, the valid operation angle range (reverse drive operation valid range) for the left operator 30L (reverse drive operator) is expanded, while the valid operation range (forward drive operation valid range) for the right operator 30R (forward drive operator) is kept as it is (Step S32). Specifically, the valid operation angle range for the left operator 30L is expanded from the ordinary valid operation angle range (−30 degrees to +150 degrees) by a predetermined counterclockwise angle (e.g., 120 degrees). In this case, the valid operation angle range for the left operator 30L is expanded to a range between −150 degrees and +150 degrees.

In this exemplary control process, the valid operation angle ranges are variably set according to the sailing speed range and the propulsive force direction (forward drive direction or reverse drive direction).

Figure 12:
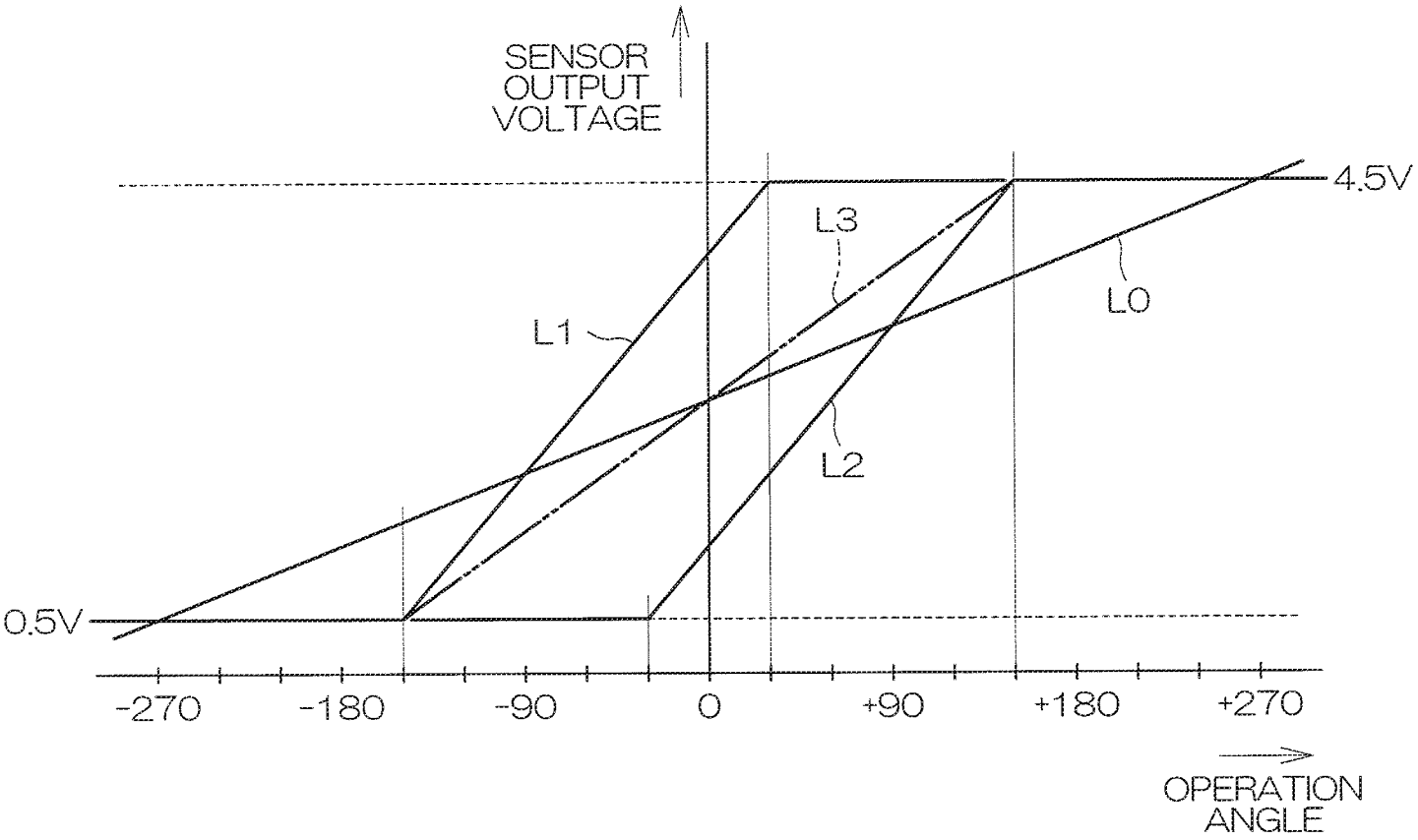
FIG. 12 is a diagram for describing a modification of the variable setting of the valid operation angle ranges, showing conversion characteristics with respect to the output voltage of the operation angle sensor.

FIG. 12 is a diagram for describing a modification of the variable setting of the valid operation angle ranges, showing conversion characteristics with respect to the output voltage of the operation angle sensor 21. The conversion characteristics are herein used by the boat controller 15 for the enabling/disabling control of the operation of the paddle operator 5, but are not used by the steering controller 13 for the control of the nozzle driver 10.

The operation angle sensor 21 outputs a voltage that is linearly variable in a range between about 0.5 V and about 4.5 V, for example, according to an operation angle between −270 degrees and +270 degrees, for example, as indicated by an ordinary characteristic L0.

The boat controller 15 assigns a given operation angle range to a valid output voltage range (e.g., between 0.5 V and 4.5 V) of the operation angle sensor 21, such that the valid operation angle range is able to be virtually changed. More specifically, characteristic data indicative of the assignment may be stored in the memory 15M (see FIG. 3).

A first characteristic L1 is such that an operation angle range between −150 degrees and +30 degrees is linearly assigned to the valid output voltage range of the operation angle sensor 21. That is, the output voltage of the operation angle sensor 21 for the operation angle range between −150 degrees and +30 degrees is linearly converted into a full output voltage range (e.g., between about 0.5 V and about 4.5 V). The converted voltage value is regarded as the output voltage value of the operation angle sensor 21. Based on this, the boat controller 15 performs a control process to disable the operation of the paddle operator 5 outside the operation angle range (between −270 degrees and +270 degrees) for the valid output voltage. Then, an input from the paddle operator 5 is disabled at an operation angle falling outside the range between −150 degrees and +30 degrees.

For example, the first characteristic L1 may be used for the forward drive paddle operation (the operation of the right operator 30R) during the ordinary sailing (see Step S3 in FIGS. 4, 7, 10, and 11). Further, the first characteristic L1 may be used for the forward drive paddle operation irrespective of the sailing state of the jet propulsion marine vessel 100 (see Step S10 in FIG. 9). Furthermore, the first characteristic L1 may be used for the forward drive paddle operation in the medium speed sailing (see Step S32 in FIG. 11).

A second characteristic L2 is such that an operation angle range between −30 degrees and +150 degrees is linearly assigned to the valid output voltage range of the operation angle sensor 21. That is, the output voltage of the operation angle sensor 21 for the operation angle range between −30 degrees and +150 degrees is linearly converted into a full output voltage range (e.g., between about 0.5 V and about 4.5 V). The converted voltage value is regarded as the output voltage value of the operation angle sensor 21. Based on this, the boat controller 15 performs a control process to disable the operation of the paddle operator 5 outside the operation angle range (between −270 degrees and +270 degrees) for the valid output voltage. Then, an input from the paddle operator 5 is disabled at an operation angle falling outside the range between −30 degrees and +150 degrees.

For example, the second characteristic L2 may be used for the reverse drive paddle operation (the operation of the left operator 30L) during the ordinary sailing (see Step S3 in FIGS. 4, 7, 10, and 11).

A third characteristic L3 is such that an operation angle range between −150 degrees and +150 degrees is linearly assigned to the valid output voltage range of the operation angle sensor 21. That is, the output voltage of the operation angle sensor 21 for the operation angle range between −150 degrees and +150 degrees is linearly converted into a full output voltage range (e.g., between about 0.5 V and about 4.5 V). The converted voltage value is regarded as the output voltage value of the operation angle sensor 21. Based on this, the boat controller 15 performs a control process to disable the operation of the paddle operator 5 outside the operation angle range (between −270 degrees and +270 degrees) for the valid output voltage. Then, an input from the paddle operator 5 is disabled at an operation angle falling outside the range between −150 degrees and +150 degrees.

For example, the third characteristic L3 may be used for the forward drive paddle operation and/or the reverse drive paddle operation when docking and undocking and in the low speed sailing (see Steps S5 and S6 in FIG. 4, Step S11 in FIG. 7, Step S22 in FIG. 10, and Step S31 in FIG. 11). Further, the third characteristic L3 may be constantly used for the reverse drive paddle operation irrespective of the sailing state of the jet propulsion marine vessel 100 (see Step S10 in FIG. 9). Further, the third characteristic L3 may be used for the reverse drive paddle operation in the low speed sailing and the medium speed sailing (see Steps S31 and S32 in FIG. 11).

Figure 13:
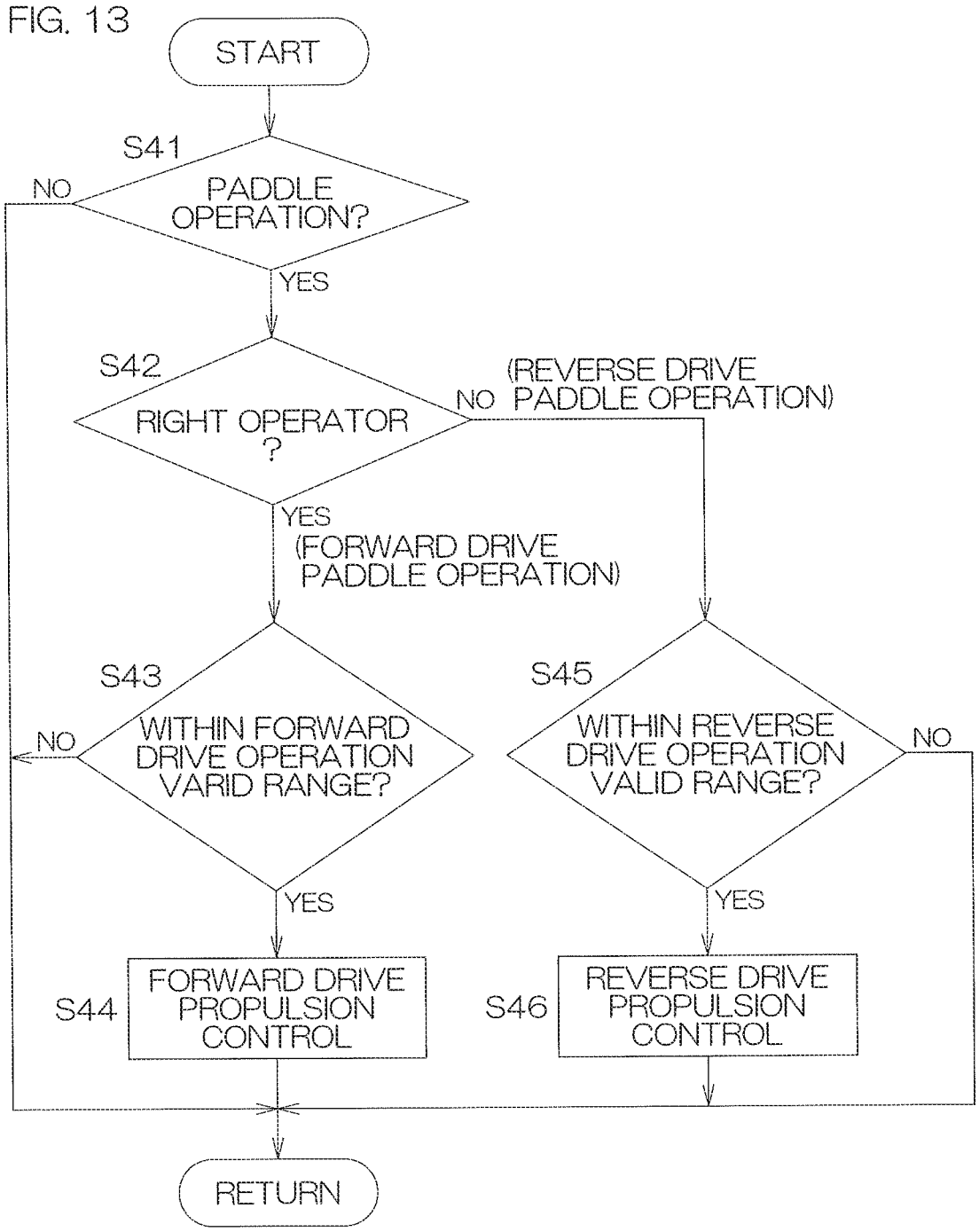
FIG. 13 is a flowchart for describing a control process to be performed by a boat controller in response to the operation of the paddle operator.

FIG. 13 is a flowchart for describing the control process to be performed by the boat controller 15 in response to the operation of the paddle operator 5. If the operation of the paddle operator 5 is detected (YES in Step S41), the boat controller 15 determines whether the operation is the forward drive paddle operation (the operation of the right operator 30R) or the reverse drive paddle operation (the operation of the left operator 30L) (Step S42).

If the forward drive paddle operation is detected (YES in Step S42), the boat controller 15 determines whether the operation angle of the steering wheel 20 falls within the forward drive operation valid range (Step S43). If the operation angle falls within the forward drive operation valid range (YES in Step S43), the boat controller 15 performs a forward drive propulsion control process (Step S44). That is, the boat controller 15 controls the bucket driver 12 so as to apply the forward drive propulsive force to the hull 1, and adjusts the output of the engine 2 according to the operation amount of the right operator 30R (forward drive operator) to control the magnitude of the propulsive force. If the operation angle of the steering wheel 20 falls outside the forward drive operation valid range (NO in Step S43), on the other hand, the forward drive propulsion control process is disabled. That is, the boat controller 15 is unresponsive to the forward drive paddle operation.

Similarly, if the reverse drive paddle operation is detected (NO in Step S42), the boat controller 15 determines whether the operation angle of the steering wheel 20 falls within the reverse drive operation valid range (Step S45). If the operation angle falls within the reverse drive operation valid range (YES in Step S45), the boat controller 15 performs a reverse drive propulsion control process (Step S46). That is, the boat controller 15 controls the bucket driver 12 so as to apply the reverse drive propulsive force to the hull 1, and adjusts the output of the engine 2 according to the operation amount of the left operator 30L (reverse drive operator) to control the magnitude of the propulsive force. If the operation angle of the steering wheel 20 falls outside the reverse drive operation valid range (NO in Step S45), on the other hand, the reverse drive propulsion control process is disabled. That is, the boat controller 15 is unresponsive to the reverse drive paddle operation.

According to the present preferred embodiment, as described above, the marine vessel user is able to steer the jet propulsion marine vessel 100 by pivoting the steering wheel 20. In addition, the marine vessel user is able to switch the direction of the propulsive force between the forward drive direction and the reverse drive direction, and control the magnitude of the propulsive force by performing the forward drive paddle operation (operating the right operator 30R) and performing the reverse drive paddle operation (operating the left operator 30L). The forward drive paddle operation is accepted when the operation angle of the steering wheel 20 falls within the forward drive operation valid range, and is negated when the operation angle of the steering wheel 20 falls outside the forward drive operation valid range. Similarly, the reverse drive paddle operation is accepted when the operation angle of the steering wheel 20 falls within the reverse drive operation valid range, and is negated when the operation angle of the steering wheel 20 falls outside the reverse drive operation valid range.

At least one of the forward drive operation valid range and the reverse drive operation valid range is variably set according to the sailing state of the jet propulsion marine vessel 100. Since the operation valid range is thus properly set according to the sailing state, the marine vessel maneuverability and the maneuvering feeling is improved.

In the first exemplary control process shown in FIG. 4 and the second exemplary control process shown in FIG. 7, the boat controller 15 performs the repeated reversal determination operation for determining whether the operating direction of the steering wheel 20 is reversed between the clockwise direction and the counterclockwise direction a plurality of times in the predetermined period (Step S2). This determination operation is an example of the docking/undocking determination operation to determine whether the sailing state of the jet propulsion marine vessel 100 is a docking/undocking sailing state. In the fourth exemplary control process shown in FIG. 10 and the fifth exemplary control process shown in FIG. 11, the boat controller 15 determines whether the marine vessel sails at not higher than the predetermined speed in the low speed sailing state (Step S21). This low speed sailing determination operation is another example of the docking/undocking determination operation.

If the sailing state of the jet propulsion marine vessel 100 is the docking/undocking sailing state, the valid range expanding control process is performed to expand at least the reverse drive operation valid range out of the forward drive operation valid range and the reverse drive operation valid range from the ordinary valid range (Steps S5, S6, S11, S22, and S31). When docking and undocking, at least the reverse drive operation valid range is thus expanded from the ordinary valid range. Therefore, the operation angle range in which at least the reverse drive paddle operation is validly accepted is expanded when docking and undocking. This facilitates the marine vessel maneuvering operation when docking and undocking, and improves the maneuvering feeling. On the other hand, the valid operation angle range for the reverse drive paddle operation is limited to a proper operation angle range by using the ordinary valid range in a sailing state other than when docking and undocking.

In the third exemplary control process shown in FIG. 9, the reverse drive operation valid range is always wider than the forward drive operation valid range and, therefore, the operation angle range in which at least the reverse drive paddle operation is validly accepted is expanded when docking and undocking. This facilitates the marine vessel maneuvering operation when docking and undocking, and improves the maneuvering feeling. When the marine vessel sails rearward, the marine vessel speed is not so high and, therefore, the limitation of the valid operation angle range for the reverse drive paddle operation is not so advantageous. Therefore, the reverse drive operation valid range is thus set wider, thus making it possible to improve the marine vessel maneuverability and the maneuvering feeling while facilitating the control process.

In the fourth exemplary control process shown in FIG. 10 and the fifth exemplary control process shown in FIG. 11, the speed-adaptive variable control process is performed to variably set at least one of the forward drive operation valid range and the reverse drive operation valid range according to the marine vessel speed (Steps S21, S22, S23, S3, S31, and S32). Thus, the forward drive paddle operation and/or the reverse drive paddle operation is enabled in an operation angle range suitable for the marine vessel speed. Since the proper operation valid range is thus variably set according to the sailing state of the jet propulsion marine vessel 100, it is possible to improve the marine vessel maneuverability and the maneuvering feeling.

As described with reference to FIG. 12, the boat controller 15 may perform the operation angle calculation characteristic changing control process to change the operation angle calculation characteristic according to the sailing state of the jet propulsion marine vessel 100 by converting the output voltage of the operation angle sensor 21. Thus, the valid operation angle ranges for the forward drive paddle operation and the reverse drive paddle operation are variably controlled. The variable control of the operation angle calculation characteristic makes it possible to improve the marine vessel maneuverability and the maneuvering feeling while facilitating the control process.

While preferred embodiments of the present invention have been described above, the present invention can be embodied in other ways as will be described below by way of example.

Figure 14:
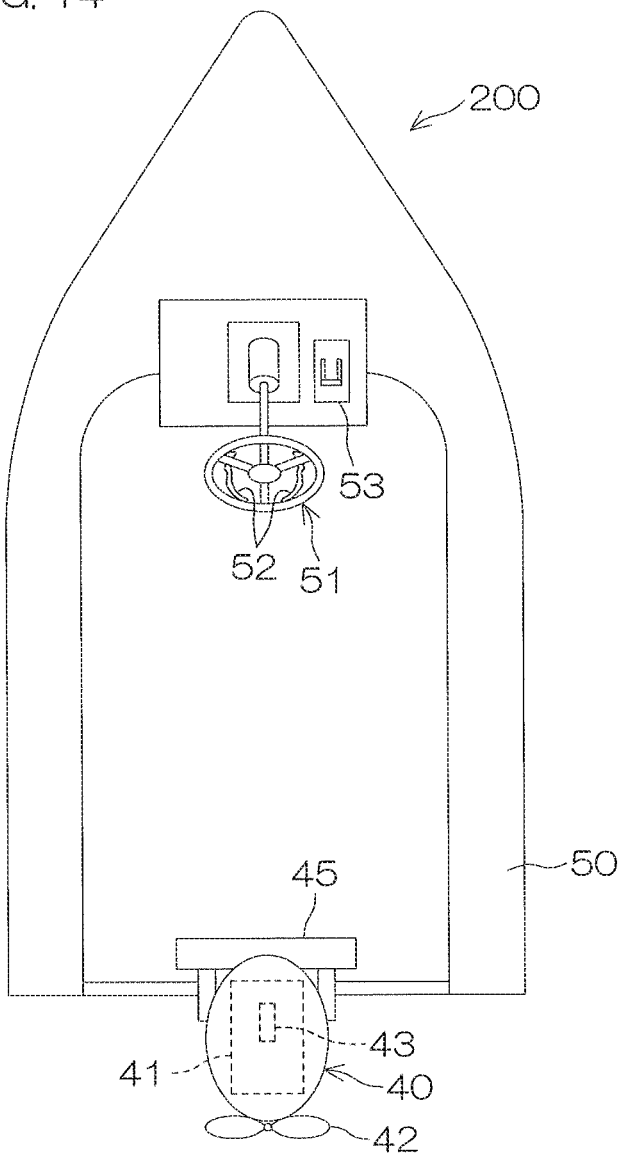
FIG. 14 is a plan view showing the construction of an outboard motorboat as another example of the marine vessel according to a preferred embodiment of the present invention.

For example, the present invention is applicable to an outboard motorboat 200 as shown in FIG. 14. The outboard motorboat 200 includes a hull 50, an outboard motor 40 provided at the stern thereof, and a steering device 45 which pivots the outboard motor 40 laterally of the hull 50. The outboard motorboat 200 further includes a steering operator 51 including a steering wheel, a paddle operator 52 including right and left operators, and a lever operator 53. The outboard motor 40 includes an engine 41, a propeller 42, and a shift mechanism 43. The driving force of the engine 41 is transmitted to the propeller 42 to generate a propulsive force. These elements define the propulsion device. The shift mechanism 43 is provided in a power transmission path extending from the engine 41 to the propeller 42 to switch the rotation direction of the propeller 42 between a forward rotation direction and a reverse rotation direction. Thus, the shift mechanism 43 defines the forward/reverse drive switch which switches the direction of the propulsive force generated by the propeller 42 between a forward drive direction and a reverse drive direction.

In the preferred embodiments described above, the operation angle sensor 21 detects the operation angle of the steering wheel 20, and the steering controller 13 controls the nozzle driver 10 based on the detected operation angle. That is, the steering wheel 20 and the steering device are electrically connected to each other, i.e., a so-called steer-by-wire system is employed. Of course, the present invention is applicable to a marine vessel including a steering system including a steering wheel 20 and a steering device mechanically connected to each other via a cable or the like.

In the preferred embodiments described above, the right operator 30R defines the forward drive operator, and the left operator 30L defines the reverse drive operator. However, the right and left operators may correspond to the forward drive and the reverse drive in any desired manner. The left operator 30L may define the forward drive operator, and the right operator 30R may define the reverse drive operator.

In the preferred embodiments described above, the specific numeric values are employed for the full operation angle range, the ordinary valid operation angle range, and the expanded valid operation angle range by way of example, but some other numeric values may be of course employed.

In the preferred embodiments described above, more specifically, the ordinary valid operation angle range for the right operator 30R is defined as including the range between 0 degree and +30 degrees on the clockwise side with respect to the neutral position and the range between 0 degree and −150 degrees on the counterclockwise side with respect to the neutral position by way of example. The ordinary valid range for the right operator 30R may be properly defined as including a range between the neutral angle and a clockwise angle of not greater than 60 degrees, and a range between the neutral angle and a counterclockwise angle of not greater than 210 degrees by way of example, but is not limited to these ranges.

Similarly, the ordinary valid operation angle range for the left operator 30L is defined as including the operation angle range between 0 degree and −30 degrees on the counterclockwise side with respect to the neutral position, and the range between 0 degree and +150 degrees on the clockwise side with respect to the neutral position by way of example. The ordinary valid range for the left operator 30L may be properly defined as including a range between the neutral angle and a counterclockwise angle of not greater than 60 degrees, and a range between the neutral angle and a clockwise angle of not greater than 210 degrees by way of example, but is not limited to these ranges.

In the preferred embodiments described above, the valid operation angle range is expanded clockwise or counterclockwise by 120 degrees by way of example, but the expansion angle value is not limited to this value. For example, the valid operation angle range may be expanded by a predetermined proper angle not smaller than 90 degrees.

In the preferred embodiments described above, the repeated reversal determination operation (to determine whether the steering wheel 20 is repeatedly reversed in the unit time) and the low speed sailing determination operation are described as examples of the docking/undocking determination operation. Otherwise, the docking/undocking determination operation may be performed based on a condition that a docking/undocking operator (e.g., a docking/undocking button) is operated when docking and undocking, that a distance between the marine vessel and the docking site is not greater than a predetermined distance, or that the current position of the marine vessel is an intended berthing position.

In the preferred embodiments described above, the marine vessel includes the single propulsion device, but may include two or more propulsion devices.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A maneuvering system for a marine vessel, the maneuvering system comprising:

a propulsion device to propel a hull;

a steering device to pivot a direction of a propulsive force generated by the propulsion device laterally of the hull;

a forward/reverse drive switch to switch the direction of the propulsive force generated by the propulsion device between a forward drive direction and a reverse drive direction;

a steering wheel pivotable about a pivot axis in a predetermined full operation angle range clockwise and counterclockwise by a user of the marine vessel to manipulate the steering device;

a forward drive operator that is pivotable together with the steering wheel about the pivot axis; and a controller configured or programmed to control the propulsion device and the forward/reverse drive switch according to operation of the forward drive operator; wherein the controller is further configured or programmed to:

perform a forward drive propulsion control when the forward drive operator is operated to switch the direction of the propulsive force generated by the propulsion device to the forward drive direction, and control a magnitude of the propulsive force generated by the propulsion device according to an operation amount of the forward drive operator; and enable the forward drive propulsion control when the operation angle of the steering wheel falls within a forward drive operation valid range in the full operation angle range, and disable the forward drive propulsion control when the operation angle of the steering wheel falls outside the forward drive operation valid range.

2. The marine vessel maneuvering system according to claim 1, wherein the forward drive operator is located on one of right and left sides of the pivot axis when an operation angle of the steering wheel is a neutral angle.

3. The marine vessel maneuvering system according to claim 1, further comprising:

a reverse drive operator that is pivotable together with the steering wheel about the pivot axis; wherein the controller is configured or programmed to control the propulsion device and the forward/reverse drive switch according to operation of the forward drive operator and the reverse drive operator;

the controller is further configured or programmed to:

perform a reverse drive propulsion control when the reverse drive operator is operated to switch the direction of the propulsive force generated by the propulsion device to the reverse drive direction, and control the magnitude of the propulsive force generated by the propulsion device according to an operation amount of the reverse drive operator; and enable the reverse drive propulsion control when the operation angle of the steering wheel falls within a reverse drive operation valid range in the full operation angle range, and disable the reverse drive propulsion control when the operation angle of the steering wheel falls outside the reverse drive operation valid range.

4. The marine vessel maneuvering system according to claim 3, wherein the reverse drive operator is located on one of right and left sides of the pivot axis when an operation angle of the steering wheel is a neutral angle.

5. The marine vessel maneuvering system according to claim 3, wherein forward drive operator is located on one of right and left sides of the pivot axis when an operation angle of the steering wheel is a neutral angle, and the reverse drive operator is located on the other of the right and left sides of the pivot axis when the operation angle of the steering wheel is the neutral angle.

6. The marine vessel maneuvering system according to claim 4, wherein the reverse drive operator is located on the left side of the pivot axis when the steering angle of the steering wheel is the neutral angle; and the reverse drive operation valid range includes a range from the neutral angle to a counterclockwise angle of not greater than 60 degrees, and a range from the neutral angle to a clockwise angle of not greater than 210 degrees.

7. The marine vessel maneuvering system according to claim 2, wherein the forward drive operator is located on the right side of the pivot axis when the operation angle of the steering wheel is the neutral angle; and the forward drive operation valid range includes a range from the neutral angle to a clockwise angle of not greater than 60 degrees, and a range from the neutral angle to a counterclockwise angle of not greater than 210 degrees.

8. A marine vessel comprising:

a hull; and the marine vessel maneuvering system according to claim 1.

* * * * *